US012251622B2

(12) United States Patent
Bouchard et al.

(10) Patent No.: US 12,251,622 B2
(45) Date of Patent: Mar. 18, 2025

(54) BILLIARD MONITORING AND MANAGEMENT SYSTEM AND METHOD

(71) Applicant: COMPUSPORT INC., Rouyn-Noranda (CA)

(72) Inventors: David Bouchard, Rouyn-Noranda (CA); Francis Côté, Rouyn-Noranda (CA); Nil Gaudet, Rouyn-Noranda (CA); Christian Lavallée, Rouyn-Noranda (CA)

(73) Assignee: COMPUSPORT INC., Rouyn-Noranda (CA)

( * ) Notice: Subject to any disclaimer, the term of this patent is extended or adjusted under 35 U.S.C. 154(b) by 797 days.

(21) Appl. No.: 17/267,228

(22) PCT Filed: Aug. 9, 2019

(86) PCT No.: PCT/CA2019/000115
§ 371 (c)(1),
(2) Date: Feb. 9, 2021

(87) PCT Pub. No.: WO2020/028970
PCT Pub. Date: Feb. 13, 2020

(65) Prior Publication Data

US 2021/0213351 A1 Jul. 15, 2021

Related U.S. Application Data

(60) Provisional application No. 62/716,419, filed on Aug. 9, 2018.

(51) Int. Cl.
*A63D 15/20* (2006.01)

(52) U.S. Cl.
CPC ..... *A63D 15/20* (2013.01); *A63B 2243/002* (2013.01)

(58) Field of Classification Search
USPC ..... 473/1
See application file for complete search history.

(56) References Cited

U.S. PATENT DOCUMENTS

2010/0062859 A1* 3/2010 Rice ..... A63D 15/20 463/43

* cited by examiner

*Primary Examiner* — Pierre E Elisca
(74) *Attorney, Agent, or Firm* — PRAXIS

(57) ABSTRACT

A system for automatic computer monitoring and management of a billiard game comprises a controller comprising a memory of processor executable code and a database of billiard game information, an image capturing system for capturing real time images of the billiard game and providing the controller with these images and a user interface. Execution of the processor executable code causes the controller to perform the computer implementable steps of storing in the database player information, identifying players of the billiard game based on the stored player formation, identifying the balls on the playing surface area of the billiard table, associating the identified balls to the identified players, assessing billiard game results by comparing the images to the stored billiard game information and communicating assessed billiard game results via the user interface. The system provides apparatus, kits and associated methods therefor.

13 Claims, 15 Drawing Sheets

BILLIARD MONITORING AND MANAGEMENT SYSTEM AND METHOD

CROSS-REFERENCE TO RELATED APPLICATIONS

The present application claims priority on U.S. Provisional Patent Application No. 67/716,419 filed on Aug. 9, 2018 and incorporated by reference herein in its entirety.

TECHNICAL FIELD

The present disclosure generally relates to billiard sports. More particularly but not exclusively, the present disclosure relates to a billiard monitoring and management system, a billiard monitoring and management apparatus and a method for billiard monitoring and management.

BACKGROUND

Cue sports or billiard sports are a wide variety of games of skill generally played with a cue stick, which is used to strike billiard balls and thereby cause them to move around a cloth-covered rectangular billiards table bounded by elastic bumpers known as cushions. The table also includes pockets at each corner and in the middle of each long side. In general, the object of the game is for a player to strike certain of the billiard balls into the pockets, what is called to pocket balls. Popular billiard sports are pool and snooker.

Popular pool games include Eight-Ball, Nine-Ball and Ten-Ball. An Eight-Ball pool game called a shot game is played with fifteen billiard balls with solid colors, numbered one through fifteen. One player must pocket balls of the group numbered one through seven, while the other player has nine balls with stripes, numbered nine through fifteen with stripes. The player pocketing either group first and then legally pocketing the black 8-ball wins the game. A player is entitled to continue shooting until failing to legally pocket a ball of their group. After a player has legally pocketed all of their group of balls, the player shoots to pocket the 8-ball. A Nine-Ball game is played with nine object balls numbered one through nine and a cue ball. On each shot, the first ball the cue ball contacts must be the lowest numbered ball on the table, but the balls need not be pocketed in order. If a player pockets any ball on a legal shot, the player remains at the table for another shot, and continues until missing, committing a foul, or winning the game by pocketing the 9-ball. After a miss, the incoming player must shoot from the position left by the previous player, but after any foul the incoming player may start with the cue ball anywhere on the table. Players are not required to call any shot. A match ends when one of the players has won the required number of games. Poker Pool is a game that uses the skill of pool with the luck of the cards to create a game that requires different strategies each time you play. In 10-ball, the same rules are used but the balls are numbered one to ten, each player needs to call each ball before taking a shot.

Snooker is played using a cue and snooker balls: one white cue ball, six, ten or fifteen red balls worth one point each, and six balls of different colors providing different points values, namely a yellow ball which is worth two points, a green ball which is worth three points, a brown ball which is worth four points, a blue ball which is worth four points, a blue ball which is worth five points, a pink ball which is worth six points and a black ball which is worth seven points. A player wins a game of snooker by scoring more points than their opponent using the cue ball to pot (i.e. to pocket) the red and colored balls. A player wins a match when they have achieved the best-of score from a predetermined number of games (known as frames). The number of frames is always odd so as to prevent a tie or a draw.

In billiard sports tournaments, scorekeeping is a manual process usually done by the actual players which causes delays, game downtime and subjective interpretations.

In order to control the cue ball on a shot, a player must master a wide variety of techniques, and have a well-founded conceptual grasp of the mechanics involved. The game of billiards requires the player to drive a ball someplace on the pool table. A player's skill is based on their understanding the why and how of a ball's trajectory.

OBJECTS

An object of the present disclosure is to provide a system for automatic computer monitoring and management of a billiard game.

An object of the present disclosure is to provide an apparatus for automatic computer monitoring and management of a billiard game.

An object of the present disclosure is to provide a kit for automatic computer monitoring and management of a billiard game.

An object of the present disclosure is to provide a method for automatic computer monitoring and management of a billiard game.

SUMMARY

In accordance with an aspect of the present disclosure, there is provided a system for automatic computer monitoring and management of a billiard game, the system comprising: a controller comprising a processor with an associated memory of processor executable code and a database of billiard game information; an image capturing system being configured for capturing real time images of the billiard game including a billiard table, a playing surface area of the billiard table, balls on the playing surface area, cue sticks engaging the balls and movement type and trajectory of the balls on the playing surface, the image capturing system being configured for and in operative communication with the controller for providing the real time captured images of the billiard game thereto; a user interface configured for and in operative communication with the controller; wherein the controller is configured for and in operative communication with the user interface and the image capturing system; wherein execution of the processor executable code causes the controller to perform the computer implementable steps of: storing in the database player information via data input selected from the group consisting of user player-identification inputs via the user interface, real time player images captured by the image capturing system, and any combination thereof; identifying players of the billiard game by assessing the stored player information to associate the players to the billiard table; identifying the balls on the playing surface area of the billiard table by way of data input comprising receiving the real time captured images of the balls on the playing surface from the image capturing system; associating a respective set of the identified balls with a respective one of the identified players by way of data input comprising receiving the real time captured images of the billiard game and comparing the real time captured images of the billiard game with the stored billiard game information thereby identifying a game relationship between a given one of the identified players and a respective one of the set of identified balls; assessing billiard game results by monitoring the movement type and the trajectory of each of the identified balls on the playing surface area by way of data input comprising receiving the real time captured images of the billiard game and comparing the real time captured images of the billiard game to the stored billiard game information wherein each identified ball being monitored is associated to a given one of the identified players based on the identified game relationship; communicating the assessed billiard game results via the user interface.

In accordance with an embodiment, the image capturing system is configured for capturing the real time images of a plurality of concurrent and successive ones of the billiard games within a billiard tournament of a plurality of the billiard game players and for providing the captured images thereof to the controller for the assessing of billiard game results of each of the plurality of concurrent and successive ones of the billiard games, wherein the stored billiard information comprises billiard tournament information; wherein the system provides for the automatic computer monitoring and management of the billiard tournament; wherein execution of the processor executable code causes the controller to perform the computer implementable steps of: evaluating a game score of each of the players based on the assessed billiard game results; matching selected ones of the players to compete against each other in a subsequent billiard game based on the evaluated game scores in accordance with the tournament information thereby providing one or more game matches; and communicating the one or more game matches via the user interface.

In an embodiment, execution of the controller executable code causes the controller to perform the computer implementable steps of: assigning a respective billiard table to the one or more game match; and communicating the billiard table assignment via the user interface.

In an embodiment, execution of the processor executable code causes the controller to perform the computer implementable steps of: ranking the players based on the assessed billiard game results; and communicating the ranking via the user interface.

In an embodiment, execution of the processor executable code causes the controller to perform the computer implementable steps of; matching selected ones of the players to compete against each other in a subsequent billiard game based on the ranking thereby providing one or more ranked game matches; and communicating the one or more ranked game matches via the user interface.

In an embodiment, execution of the processor executable code causes the controller to perform the computer implementable steps of: assessing player performance for a given player by monitoring cue stick strikes on the identified balls and the resulting movement type and the trajectory of the identified balls on the playing surface area by way of data input comprising receiving the real time captured images of the billiard game and comparing the real time captured images of the billiard game to the stored billiard game information in order to assess player performance, wherein the assessed player performance comprises evaluated player caliber; communicating the assessed player performance via the user interface. In an embodiment, execution of the processor executable code causes the controller to perform the computer implementable steps of: accumulating the assessed player performance of a plurality of players over a plurality of the billiard games; storing the accumulated player performance in the database; analyzing the accumulated player performance in order to provide billiard game statistics. In an embodiment, execution of the processor executable code causes the controller to perform the computer implementable step of: communicating the billiard game statistics via the user interface. In an embodiment, execution of the processor executable code causes the controller to perform the computer implementable step of: assessing game playing strategies based on the billiard game statistics or based on the billiard game statistics and the billiard game information.

In an embodiment, the user interface comprises one or more interface devices. In an embodiment, the controller executable code causes the controller to perform the computer implementable step of selectively providing information related to billiard game activity to the one or more interface devices and/or a selective subset thereof. In an embodiment, at least one of the one or more interface devices comprises a display for displaying controller provided images. In an embodiment, the controller provided images are selected from the group consisting of real time captured images, controller generated images and a combination thereof.

In an embodiment, the user interface comprises at least one input module being configured for allowing billiard players to the player-identification information to the database.

In an embodiment, the image capturing system comprises an image capturer. In an embodiment, the image capturer comprises at least one camera.

In accordance with an aspect of the present disclosure, there is provided an apparatus for automatic computer monitoring and management of a billiard game, the apparatus comprising: a controller comprising a processor with an associated memory of processor executable code and a database of billiard game information; an image capturer being configured for capturing real time images of the billiard game including a billiard table, a playing surface area of the billiard table, balls on the playing surface area, cue sticks engaging the balls and movement type and trajectory of the balls on the playing surface, the image capturer being configured for and in operative communication with the controller for providing the real time captured images of the billiard game thereto; a user interface configured for and in operative communication with the controller; wherein the controller is configured for and in operative communication with the user interface and the image capturer; wherein execution of the processor executable code causes the controller to perform the computer implementable steps of: storing in the database player information via data input selected from the group consisting of user player-identification inputs via the user interface, real time player images captured by the image capturer, and any combination thereof; identifying players of the billiard game by assessing the stored player information to associate the players to the billiard table; identifying the balls on the playing surface area of the billiard table by way of data input comprising receiving the real time captured images of the balls on the playing surface from the image capturer; associating a respective set of the identified balls with a respective one of the identified players by way of data input comprising receiving the real time captured images of the billiard game and comparing the real time captured images of the billiard game with the stored billiard game information thereby identifying a game relationship between a given one of the identified players and a respective one of the set of identified balls; assessing billiard game results by monitoring the movement type and the trajectory of each of the identified balls on the playing surface area by way of data input comprising receiving the real time captured images of the billiard game and comparing the real time captured images of the billiard game to the stored billiard game information wherein each identified ball being monitored is associated to a given one of the identified players based on the identified game relationship; communicating the assessed billiard game results via the user interface.

In accordance with an aspect of the present disclosure, there is provided a kit for automatic computer monitoring and management of a billiard game, the kit comprising: a controller comprising a processor with an associated memory of processor executable code and a database of billiard game information; at least one image capturer being configured for capturing real time images of the billiard game including a billiard table, a playing surface area of the billiard table, balls on the playing surface area, cue sticks engaging the balls and movement type and trajectory of the balls on the playing surface, the image capturer being configured for being arranged in operative communication with the controller for providing the real time captured images of the billiard game thereto; at least one user interface configured for being arranged operative communication with the controller; wherein the controller is configured for being arranged operative communication with the at least one user interface and the at least one image capturer; wherein execution of the processor executable code causes the controller to perform the computer implementable steps of: storing in the database player information via data input selected from the group consisting of user player-identification inputs via the user interface, real time player images captured by the image capturer, and any combination thereof; identifying players of the billiard game by assessing the stored player information to associate the players to the billiard table; identifying the balls on the playing surface area of the billiard table by way of data input comprising receiving the real time captured images of the balls on the playing surface from the image capturer; associating a respective set of the identified balls with a respective one of the identified players by way of data input comprising receiving the real time captured images of the billiard game and comparing the real time captured images of the billiard game with the stored billiard game information thereby identifying a game relationship between a given one of the identified players and a respective one of the set of identified balls; assessing billiard game results by monitoring the movement type and the trajectory of each of the identified balls on the playing surface area by way of data input comprising receiving the real time captured images of the billiard game and comparing the real time captured images of the billiard game to the stored billiard game information wherein each identified ball being monitored is associated to a given one of the identified players based on the identified game relationship; communicating the assessed billiard game results via the at least one user interface.

In accordance with an aspect of the present disclosure, there is provided a method for automatic computer monitoring and management of a billiard game, the system comprising: providing a database of stored billiard game information; capturing real time images of the billiard game including a billiard table, a playing surface area of the billiard table, balls on the playing surface area, cue sticks engaging the balls and movement type and trajectory of the balls on the playing surface; storing in the database player information via data input selected from the group consisting of user player-identification inputs, real time player images captured by, and any combination thereof; identifying players of the billiard game by assessing the stored player information to associate the players to the billiard table; identifying the balls on the playing surface area of the billiard table by way of data input comprising receiving the real time captured images of the balls on the playing surface; associating a respective set of the identified balls with a respective one of the identified players by way of data input comprising receiving the real time captured images of the billiard game and automatically comparing the real time captured images of the billiard game with the stored billiard game information thereby identifying a game relationship between a given one of the identified players and a respective one of the set of identified balls; assessing billiard game results by automatically monitoring the movement type and the trajectory of each of the identified balls on the playing surface area by way of data input comprising receiving the real time captured images of the billiard game and automatically comparing the real time captured images of the billiard game to the stored billiard game information wherein each identified ball being monitored is associated to a given one of the identified players based on the identified game relationship; automatically communicating the assessed billiard game results.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Figure 1:
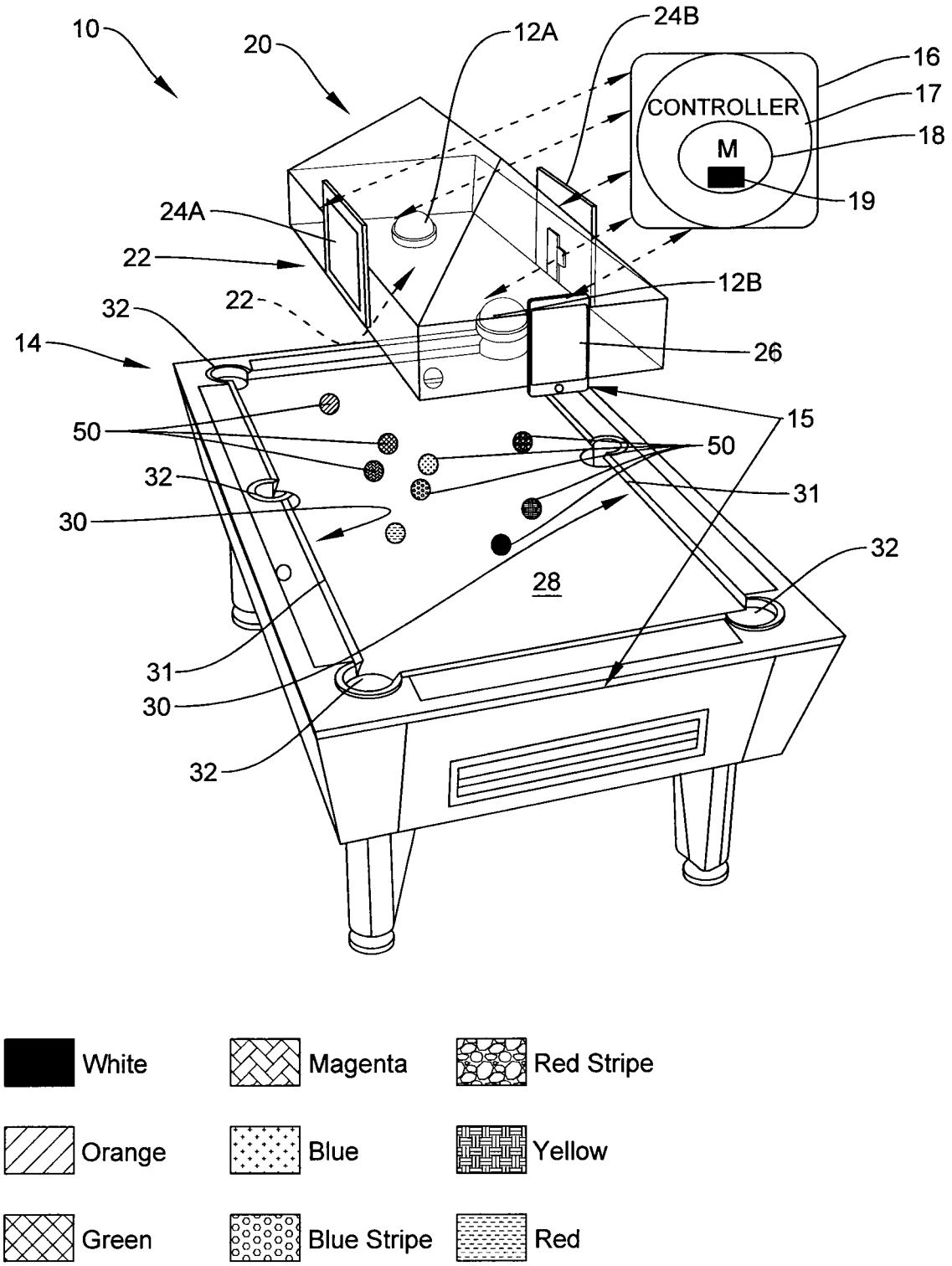
FIG. 1 is perspective top view of a system for automatic computed monitoring and managing of a billiard game including a pool table and lighting fixture in accordance with a non-limiting illustrative embodiment of the present disclosure.

Generally stated and in accordance with an aspect of the present disclosure, there is provided a system for automatic computer monitoring and management of a billiard game. The system comprises a controller, an image capturing system and a user interface. The controller comprises a processor with an associated memory of processor executable code and a database of billiard game information. The image capturing system is configured for capturing real time images of the billiard game including a billiard table, a playing surface area of the billiard table, balls on the playing surface area, cue sticks engaging the balls and movement type and trajectory of the balls on the playing surface. The image capturing system is configured for and is in operative communication with the controller for providing the real time captured images of the billiard game thereto. The user interface is configured for and is in operative communication with the controller. The controller is configured for and is in operative communication with the user interface and the image capturing system. Execution of the processor executable code causes the controller to perform the computer implementable steps of storing in the database player information, identifying players of the billiard game, identifying the balls on the playing surface area of the billiard table, associating the identified balls to the identified players, assessing billiard game results and communicating assessed billiard game results. Player information is stored via data input selected from the group consisting of user player-identification inputs via the user interface, real time player images captured by the image capturing system, and any combination thereof. Players are identified by assessing the stored player information to associate the players to the billiard table. Balls are identified on the playing surface area of the billiard table by way of data input comprising receiving the real time captured images of the balls on the playing surface from the image capturing system. Associating a respective set of the identified balls with a respective one of the identified players is accomplished by way of data input comprising receiving the real time captured images of the billiard game and comparing the real time captured images of the billiard game with the stored billiard game information thereby identifying a game relationship between a given one of the identified players and a respective one of the set of identified balls. The billiard game results are assessed by monitoring the movement type and the trajectory of each of the identified balls on the playing surface area by way of data input comprising receiving the real time captured images of the billiard game and comparing the real time captured images of the billiard game to the stored billiard game information wherein each identified ball being monitored is associated to a given one of the identified players based on the identified game relationship. The assessed billiard game results are communicated via the user interface.

The present system provides for monitoring a billiard game such as snooker, pool and the like by way of image capturers in communication with a controller comprising a memory of computer implementable steps. The system can thus monitor the balls on the playing surface area. The system distinguishes between the balls and the playing surface as well as being able to distinguish between the balls. Thus, the system identifies each ball in the context of the game (i.e. cue ball, eight ball, solid color ball, striped ball, color of the ball, number of the ball). The system identifies the position of each ball on the playing surface and follows its trajectory on the playing surface including the speed thereof.

The system can asses the angle of the shot taken, the angle of the cue stick and the point on the ball the cue stick hits as well as the type movement of the ball. The system can assess how the cue ball strikes the object ball (i.e. "cut", "dead one" etc.). Of course, the system assesses pocketing of the balls. As such, the system will assess when and how a player takes a shot and it will follow the trajectory of movement type of the ball—both the cue and the object ball and any intervening ball and thus the system assesses mistakes. Accordingly, the system calculates the statistics of players such as the success of their shots for example. Thereby the system keeps score during tournaments and provides statistics not only of a given tournament but over a series of tournaments. The system provides for assessing the number of players, the number of balls in a row, the number of defensive shots, the percentage of successful defensive and offensive shots and other like information.

The system provides for automatically managing tournaments and thus management of pool tables in a game hall can be paperless. The system provides for attributing pool tables in a game hall automatically by knowing whether or not a given table is available. The system sends a notification via common display viewable in the game hall or a personal message via email, text or an app notice of the next match to players.

With respect to Figures, non-restrictive illustrative embodiments of the disclosure will be described to further exemplify the disclosure and by no means limit the scope thereof.

With reference to FIGS. 1-4, there is shown a system 10 for automatic computer monitoring and management of a game of billiard such as pool or snooker. As is shown, the system 10 includes an image capturing system 12. In As shown the image capturing system 12 comprises an image capturer mounted above the billiard table 14 and in operational communication with a controller 16. The controller 16 comprises a processor 17 which includes an associated memory 18 of processor executable code which allows for computer implementable steps. The controller 16 also comprises a database 19 of billiard game information. The billiard game information includes billiard game rules and other like information that is predetermined during building of the database 19 as will be discussed herein. The database 19 also provides for receiving new information as will be discussed herein.

In this example, the image capturer 12 includes an image capturing assembly in the form of a pair of cooperating devices, namely a pair of cameras 12A and 12B mounted within the light fixture 20 positioned above the table 14.

The system 10 also includes an interface 22 which is communication with the controller 16. The image capturer 12, the interface 22 and the controller 16 are configured for operative communication as provided herein.

In this example, the interface 22 includes a display 24 in the form of screens 24A and 24B mounted externally of the light fixture 20 to be conveniently visible to players and spectators. The interface 22 also includes an input module 26 in the form of a tablet for example, that is shown to be positioned on the light fixture 20 or on one of the sides 15 of the table 14. The input module 26 provides for users to control the system 10 or to input data such as player-identification information, additional billiard game information and like information into the database 19.

In an embodiment, the interface 22 includes a plurality of computer implementable applications or apps that are displayed to remote spectators on various display units such as handheld devices, computer monitors or larger screens in homes or sports bars for example. Therefore, the interface 22 also includes a variety of displays to local and remote spectators. The controller 16 thus communicates with the interface 22 including the remote interface devices and displays thereof via a network communication (e.g. the Internet).

Figure 2:
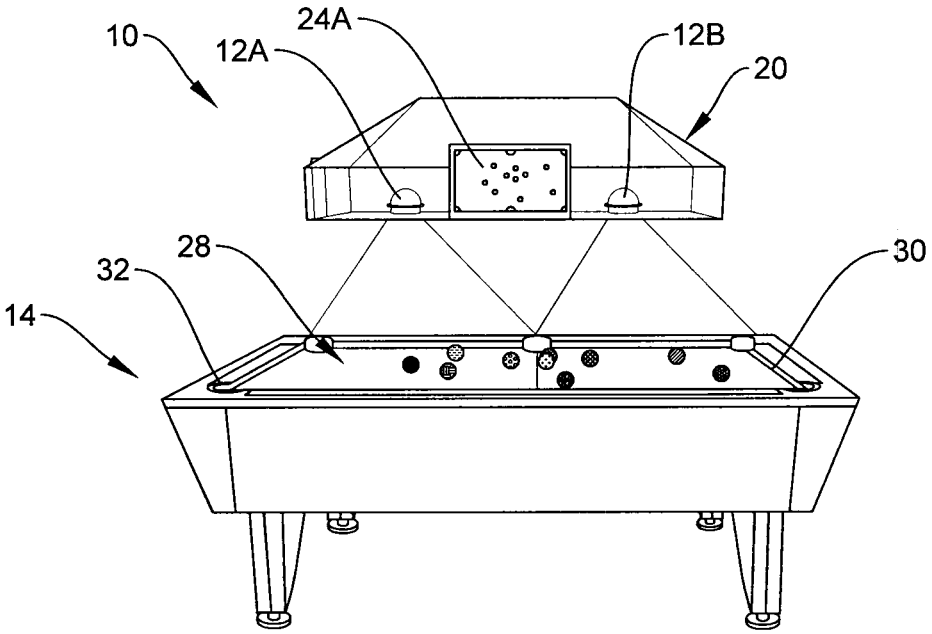
FIG. 2 is a side view of the system of FIG. 1.
Figure 3:
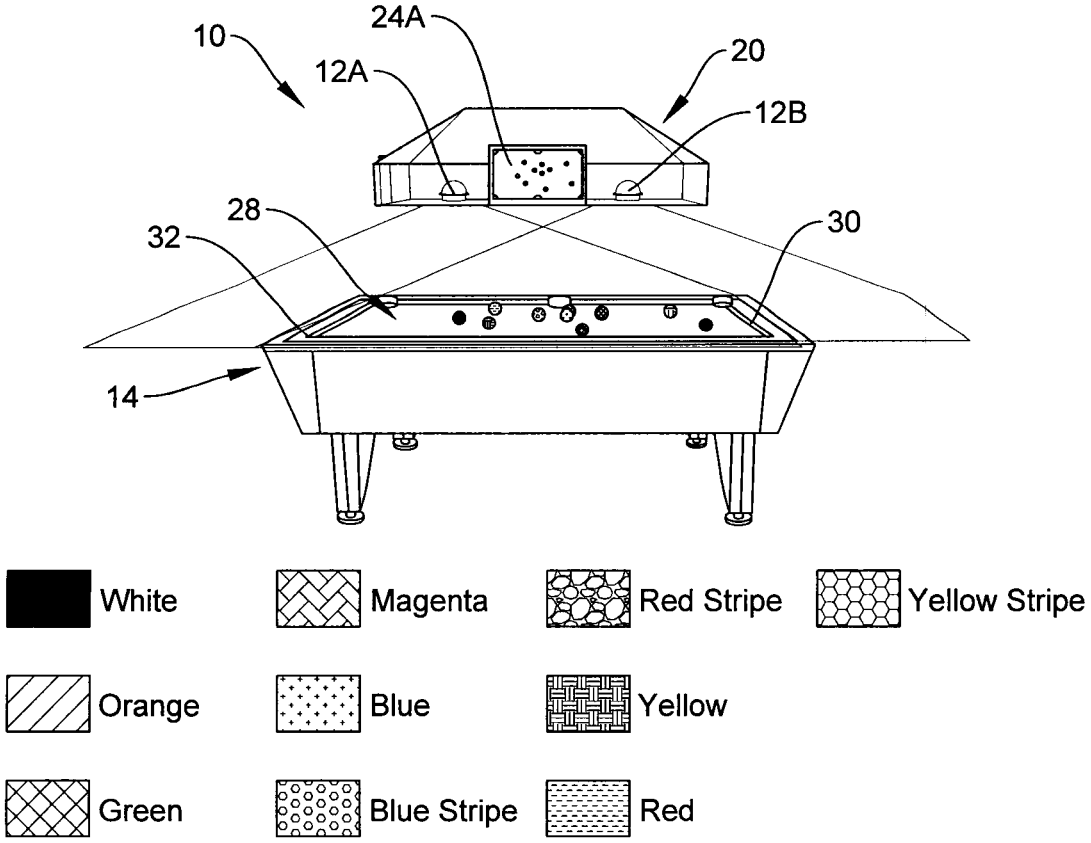
FIG. 3 is a side view of the system of FIG. 1.

Turning now to FIG. 2, in an embodiment of the system 10, each camera 24A and 24B covers an area of 50% of the playing surface area 28 on the table 14. The playing surface area 28 is delimited by edges (i.e. the rails) 30 which includes the cushions 31. There are six pocket holes 32 formed in the playing surface area 20. In an embodiment, as shown in FIG. 3, the angle of each camera 12A and 12B can be increased so that both cameras 12A and 12B cover and area greater than the playing surface area 28. A variety of camera types can be used in the context of the present system 10, including and without limitation, 2-D cameras, 3-D cameras, Kinect-type cameras, stereo cameras and combinations thereof as will be further discussed herein.

Figure 4:
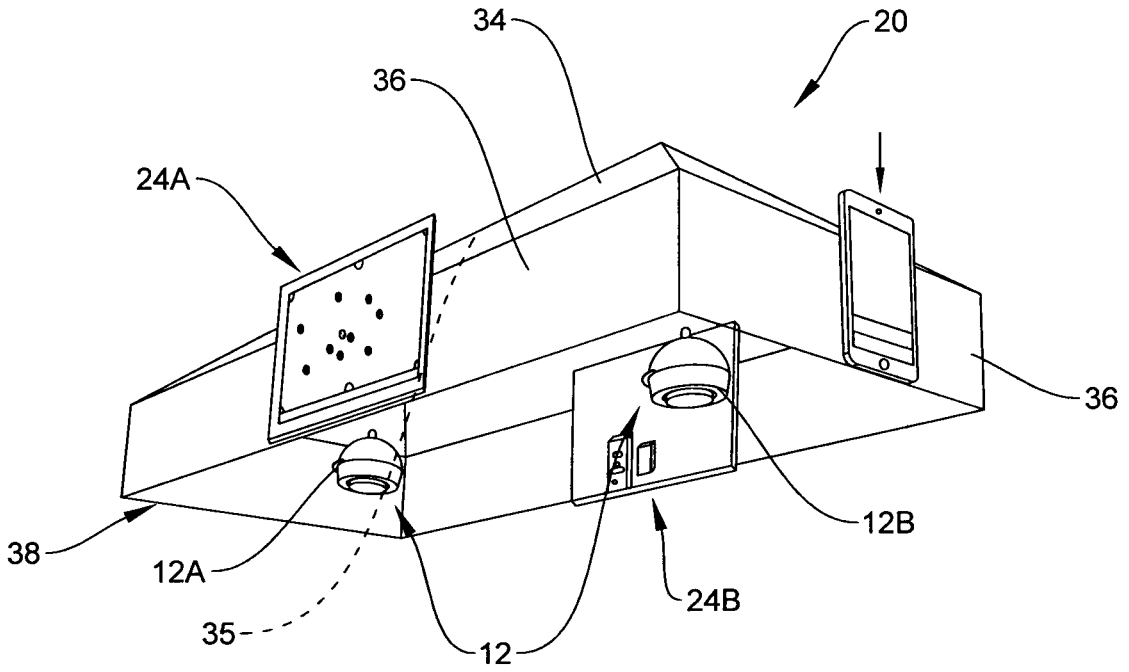
FIG. 4 is a bottom, front and side perspective view of the lighting fixture and image capture of FIG. 1.

Turning now to FIG. 4, the light fixture 20 includes a top panel 34 and side panels 36 downwardly depending therefrom with an open bottom face 38, The display screens 24A and 24B are shown mounted to respective side panels 36. In an embodiment, when no game is underway, the screens 24A and 24B can display advertisements, league sporting statistics, including the photos and statistics of players in past or upcoming matches. As shown the cameras 12A and 12B are connected to the inner surface 35 of the top panel 34. The light (not shown) is also mounted to the inner surface 35. In an embodiment, the controller 16 is also mounted to the inner surface 35.

Figure 5:
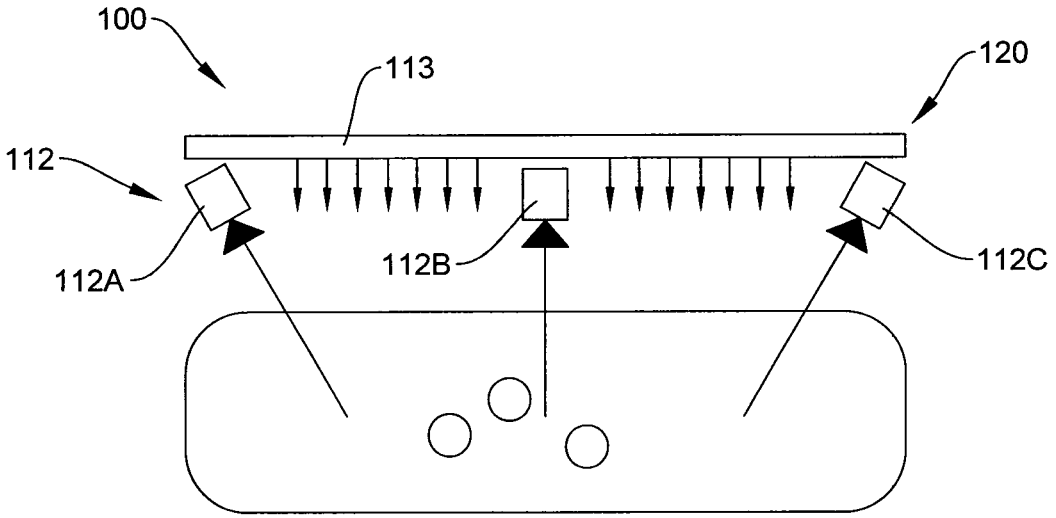
FIG. 5 is a schematic representation of a system for automatic computed monitoring and managing of a image capturing assembly in accordance with a non-limiting illustrative embodiment of the present disclosure.
Figure 6A:
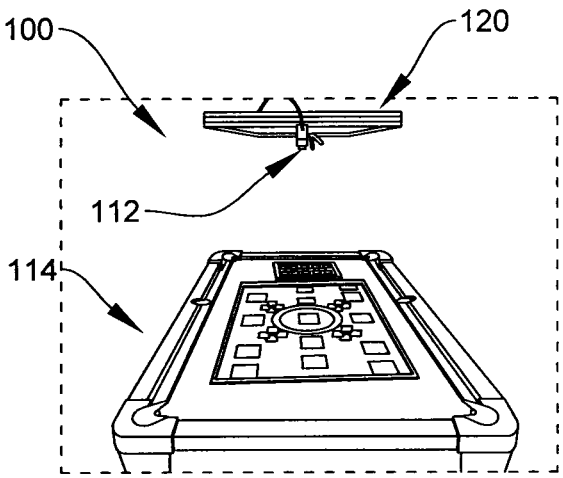
FIG. 6A-6D are photographs of the system represented in FIG. 5 including a pool table and a light fixture.
Figure 6B:
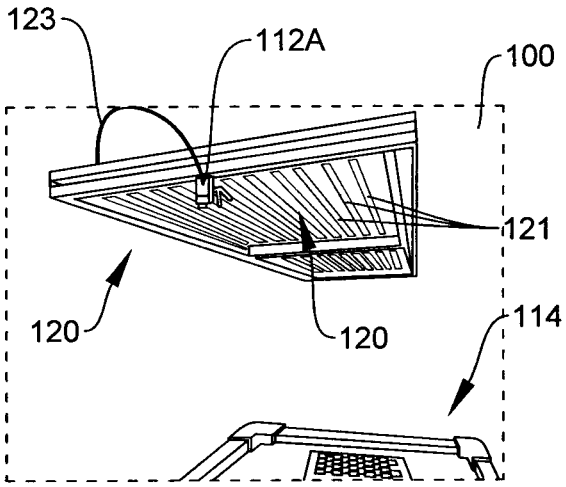
Figure 6C:
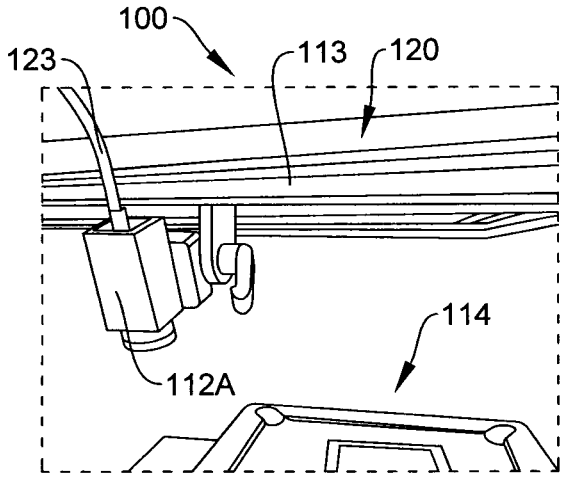
Figure 6D:
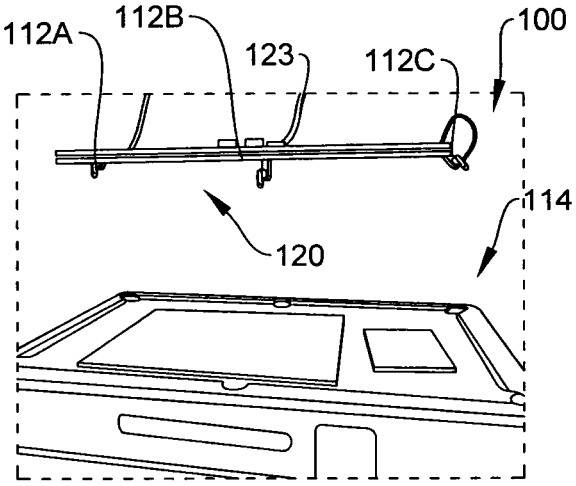

Turning now to FIG. 5, there is shown a system 100 for automatic computer monitoring and management of a game of billiard such as pool or snooker that is similar to system 10. As is shown, the system 100 includes an image capturer 112 mounted above the billiard table 14 and in operative communication with a controller (not shown). In this example, the image capturer 12 comprises an assembly of three cooperating devices namely three cameras 112A, 112B and 112C mounted along the backing 113 of a light fixture 120 positioned above the table 14.

The system 100 is further exemplified in FIGS. 6A-6D. The light fixture 120 is shown including a backing 113 with lamps 121 mounted thereto for lighting the pool table 14. The cameras 112A, 112B and 112C are connected to a controller via respective cables 123.

Figure 7:
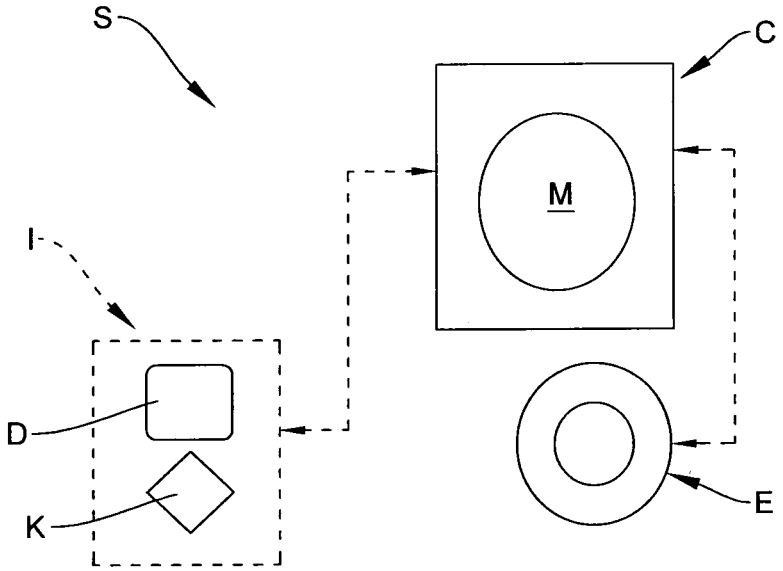
FIG. 7 is a schematic representation of a system for automatic computed monitoring and managing of a billiard game including a controller, an image capturer and an interface in accordance with a non-limiting illustrative embodiment of the present disclosure.

FIG. 7 is a schematic representation of a system S for automatic computer monitoring and managing a game of billiard such as pool or snooker including systems 10 and 100 described herein. As shown, system S includes a controller C (including a processor) having a memory M of controller executable code that when executed performs computer implementable steps and being in operative communication with an image capturing system E an interface I including a display D and an input module K.

In an embodiment, the image capturing system E comprises an image capturer which comprises one or more image capturing assemblies further comprising one or more image capturing devices. In an embodiment, the image capturing devices comprise cameras. The image capturing devices are positioned at one or more billiard tables at the lights above the playing area and/or another suitable image capturing area for capturing images of the billiard table and billiard games. Accordingly, the controller C monitors a plurality of billiard tables and games, which can be non-associated games, or which can be associated games within the context of a billiard tournament. In an embodiment, Image capturing devices are mounted at an entrance and other areas of a billiard game hall in order to identify players via facial recognition as is known in the art. In an embodiment, the input module K includes a scanner or RFID reader or other smart label reader for providing players to 'check in' or register within the game playing are or for a game or tournament.

Turning now to FIGS. 8-16, the process of image capturing and analysis will now be described in accordance with a non-limiting illustrative embodiment. When the controller executable code in the memory M is executed the controller performs the following computer implementable steps: (i) calibration of the captured image; (ii) detection of the balls in the image; (iii) localisation of the balls in the captured image; (iv) identification of the balls within the captured image. Each step (i), (ii), (iii) and (iv) further includes computer implementable sub-steps performed by the controller C when executing the controller executable code contained in the memory M associated to the controller C.

i)—Calibration of the Captured Image

Calibration of the captured image is effectuated to correct distortions produced by the lens of the camera (e.g. 12A, 12B, 112A, 112B, 112C0 as well as to provide a referencing system for the plane defined playing surface area 28.

Figure 8:
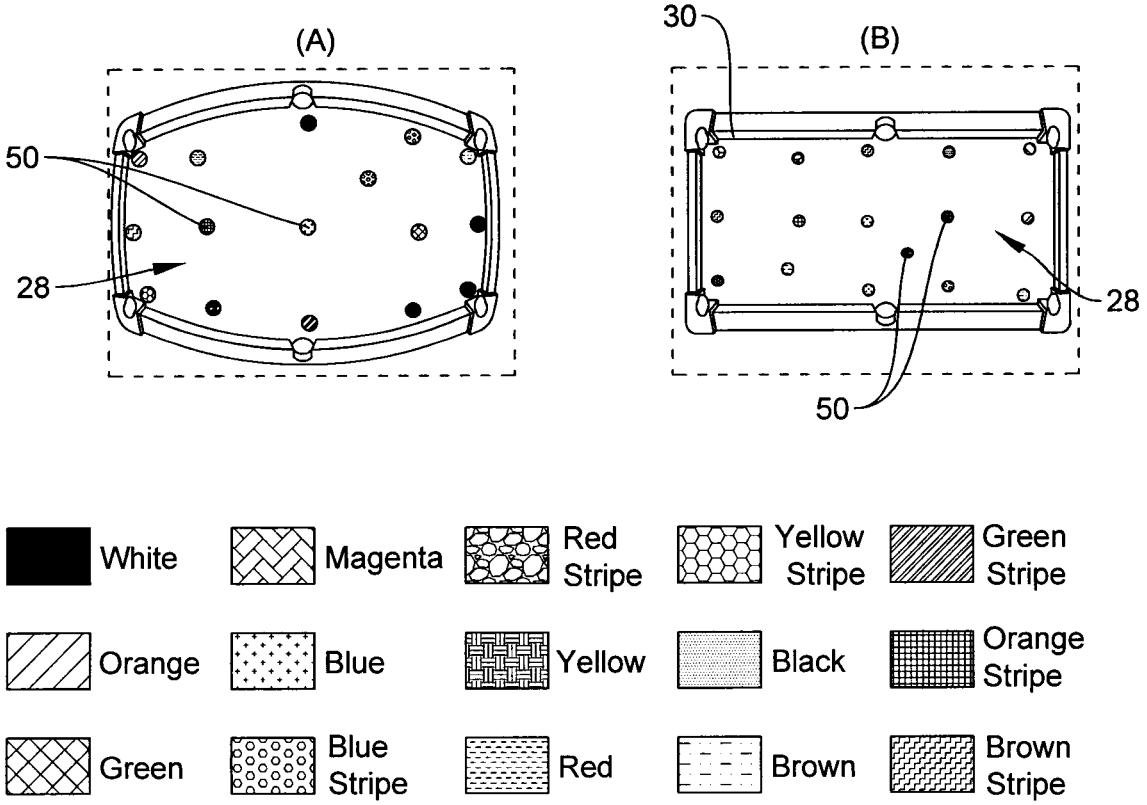
FIG. 8 shows non-calibrated and calibrated images captured by the image capturer of a system for automatic computed monitoring and managing of a billiard game in accordance with a non-limiting illustrative embodiment of the present disclosure.

As shown in FIG. 8, a captured image A is distorted as wide-angle lenses produce a fish-eye effect and provide for a circular image. Therefore, a calibration step is implemented to calibrate the image A to compensate for the distortion created by the lens by straightening the image lines and thereby rectifying the fish-eye effect of the wide-angle lens as shown in the corrected or calibrated image B.

It should be noted that the correcting the geometric distortion of image A does not automatically correct the perspective distortion effect, which in fact is amplified in image B resulting in balls 50 that are more elliptical near the edges 30 of the playing surface area 28. The perspective distortion effect is corrected by an implemented calibration step therefor.

Localisation (which will be described further below) of the balls 50 on the playing surface area 28 requires implementing a calibration step to calibrate the plane of the playing surface area in the captured images. Therefore, the controller C implements the step of providing a grid reference map of the playing surface area in order to define locations thereon by way of Cartesian coordinates.

Figure 9:
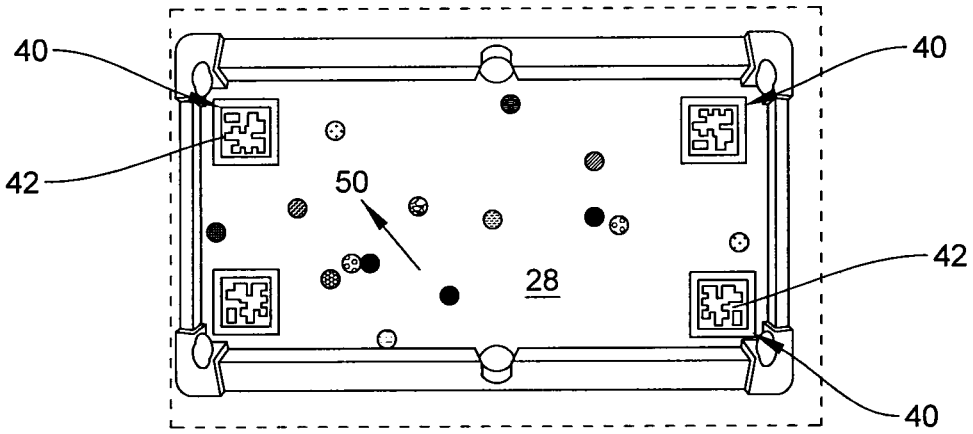
FIG. 9 shows a captured image corrected by corner tags by the controller of the system for automatic computed monitoring and managing of a billiard game in accordance with a non-limiting illustrative embodiment of the present disclosure.

In an embodiment, the step of calibrating the plane of the playing surface area 28 includes tagging the corners 40 of the playing surface area 28. In this example, the four corners 40 of the playing surface area 28 are tagged by way of April Tags 42 as shown in FIG. 9. The tags are positioned as closely as possible to the cushioned edges 30 of each corner 40 to provide the four end points of the rectangular plane grid thereby providing to build longitudinal and latitudinal lines therebetween to define the coordinate points at each intersection between the longitudinal and latitudinal lines.

Figure 10:
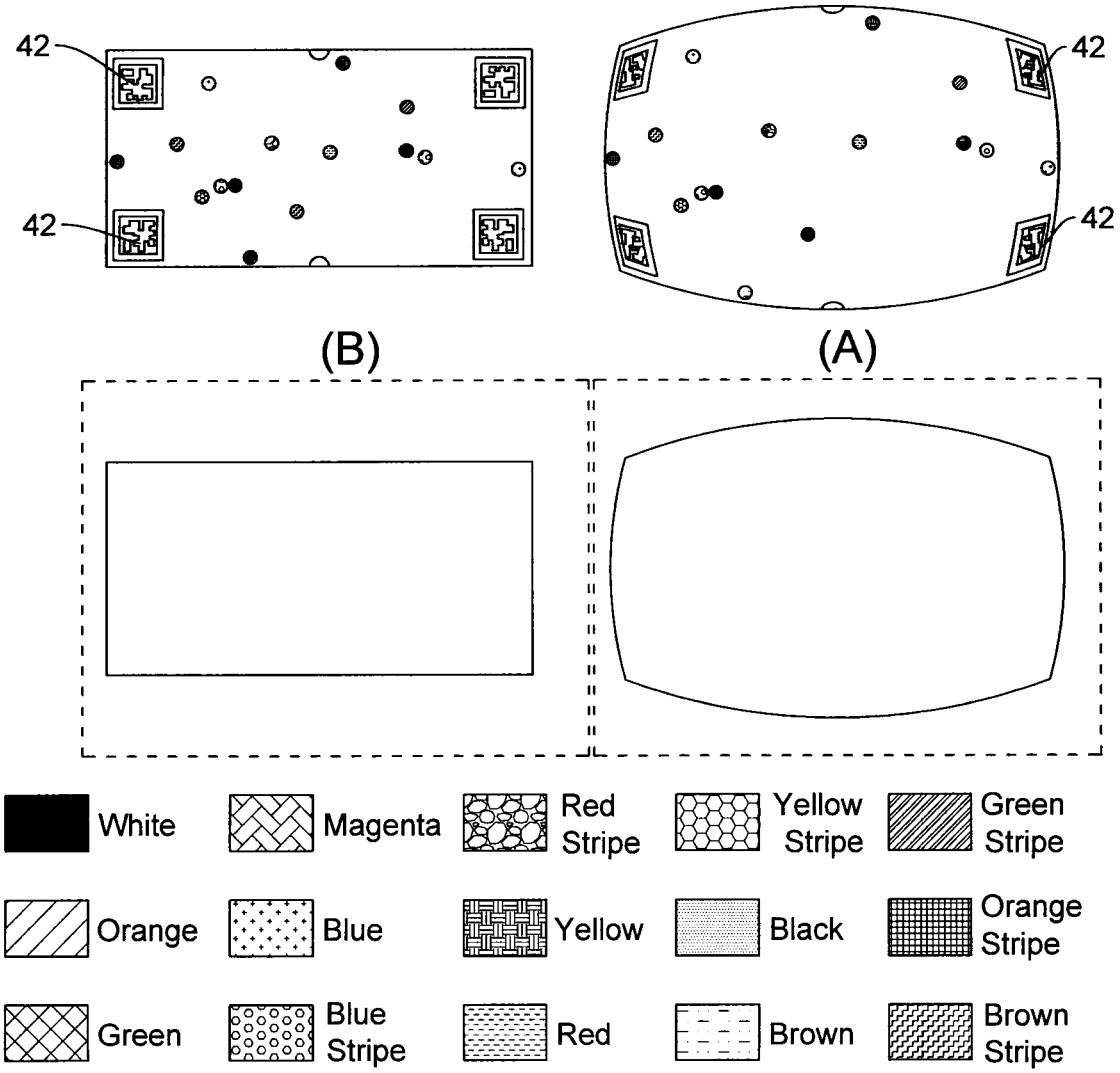
FIG. 10 shows captured images cropped by the controller of the system for automatic computed monitoring and managing of a billiard game in accordance with a non-limiting illustrative embodiment of the present disclosure.

As shown in FIG. 10, the tags 42 also serve to crop the image to the playing surface area to mask or blank out the rest of the table 14. Indeed, cropping can be done on the rectified image B as well as on the initial fish-eye image the white pixels of the black and white images will be considered while the black pixels ignored. It is thus possible to locate, ball positions on the playing surface are 28 are on both rectified images B or non-rectified images A since the masked area of both images is known.

ii)—Detection of the Balls Within the Image

In a non-limiting example, the step of detecting the balls 50 which includes segmenting or separating the balls 50 (i.e. distinguishing between balls) is provided by a computer-implementable color approach protocol and/or a computer-implementable filtering approach protocol. In the color approach, balls 50 are detected/segmented according to their color. In the filtering approach, balls are detected/segmented based on their pixel intensity.

Regarding detection/segmentation by color, the color of each ball 50 is compared to the color of the green cloth of the playing surface area 28. The balls 50 are thus segmented depending on their probability of forming part of the cloth.

Initially, the color of the cloth is modelled by a series of images of the table 14 where only the cropped green playing surface area 28 is maintained, A 5-dimensional histogram is used including the 3 dimensions of the CIELAB color space and the x and y spatial coordinates for modelling lighting variations based on the position of the balls 50 on the green cloth (28). CIELAB is abbreviated as simply "Lab" color space and expresses color as three numerical values, L* for the lightness and a* and b* for the green-red and blue-yellow color components. Each pixel is assessed in accordance with its Lab,xy attributes within a Histogram Back Projection model in order to determine its probability of forming part of the green cloth or not.

Figure 11:
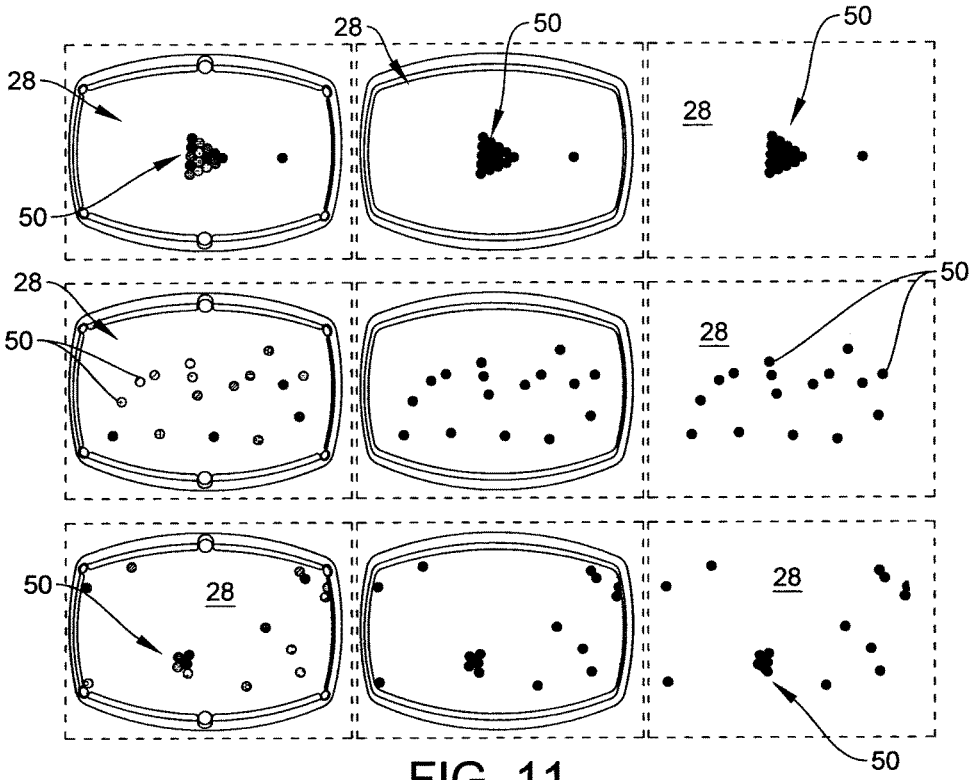
FIG. 11 shows captured images being segmented in accordance with image segmenting steps provided by the controller of the system for automatic computed monitoring and managing of a billiard game in accordance with a non-limiting illustrative embodiment of the present disclosure.

FIG. 11 shows three examples of image segmentation of the playing surface area 28 and the balls 50 using two approaches. The balls 50 that are near each other form a single region and are not separately identifiable. Balls 50 near the edges and pockets are also difficult to detect due to low lighting. The balls need to be separated (i.e. localisation of the balls) in order to be identified (detected).

Figure 12:
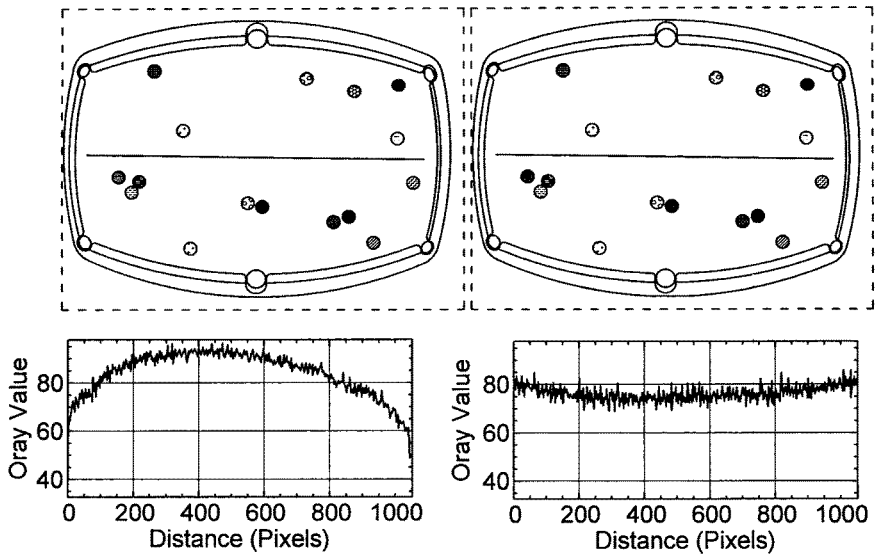
FIG. 12 shows the profile intensity of a plot of single pixel values along a line in a first image and in a second image being adjusted by the controller of the system for automatic computed monitoring and managing of a billiard game in accordance with a non-limiting illustrative embodiment of the present disclosure.

Regarding detection by filtering, an initial computer-implementable luminance equalization step is executed in order to optimize segmentation. This step provides for reducing the vignette effect and to even out pixel intensity of the cropped green playing surface background 28. The foregoing provides for thresholding the value of each pixel by a constant threshold value to obtain a coherent filtered image. FIG. 12 shows the profile intensity of a plot of single pixel values along a yellow line. A constant threshold value is obtained based on the intensity profile of the initial image on the left. The image on the right is obtained from the image of the left following luminance equalization which results in evening out pixel intensity based on the constant threshold value.

Figure 13:
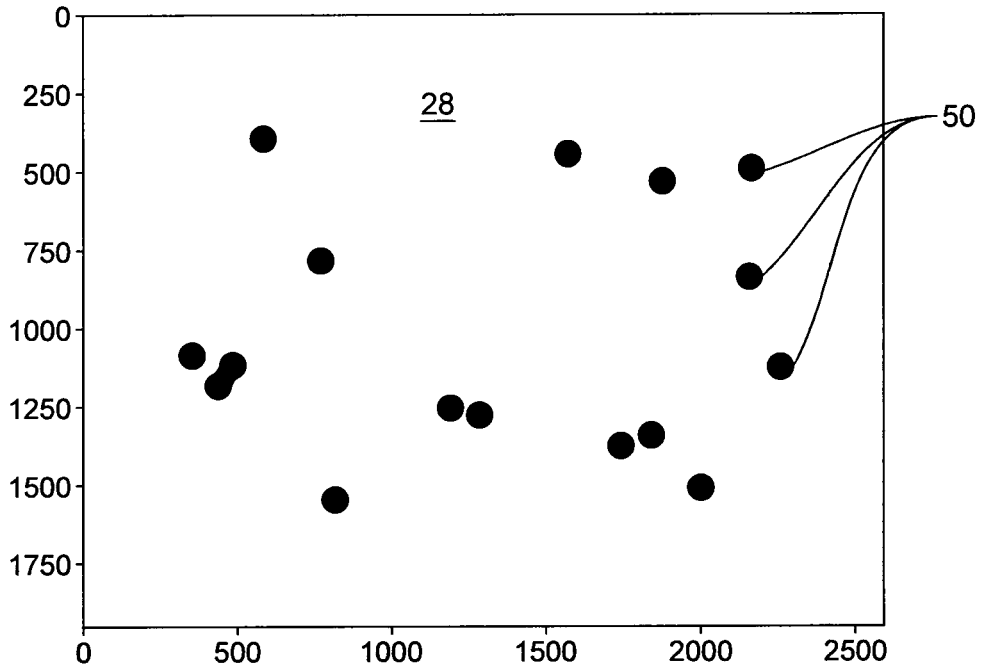
FIG. 13 shows a captured image in which the balls are detected by the implementation of a Laplacian-of-Gaussian (LoG) filter by the controller of the system for automatic computed monitoring and managing of a billiard game in accordance with a non-limiting illustrative embodiment of the present disclosure.

Turning to FIG. 13, the balls are further detected by applying a blob detector such as a Laplacian-of-Gaussian (LoG) filter. Blob detection methods are aimed at detecting regions in a digital image that differ in properties, such as brightness or color, compared to surrounding regions. The balls 50 in FIG. 13 are shown in white while the playing background area 28 in black.

iii)—Localisation of the Balls Within the Image

Figure 14:
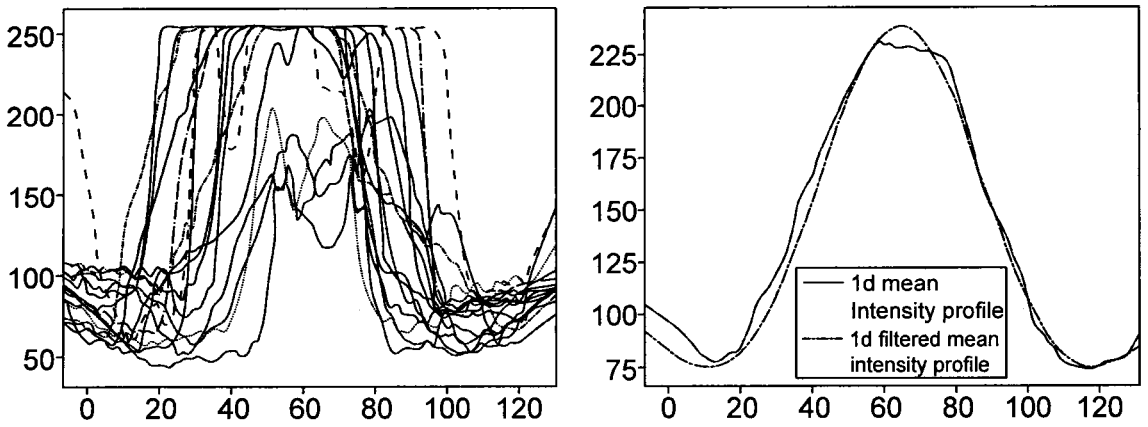
FIG. 14 is a graphical representation of the pixel profile intensity of the pool balls in the captured images and of both the mean intensity profile and the filtered mean intensity profile as provided by the controller of the system for automatic computed monitoring and managing of a billiard game in accordance with a non-limiting illustrative embodiment of the present disclosure.
Figure 15:
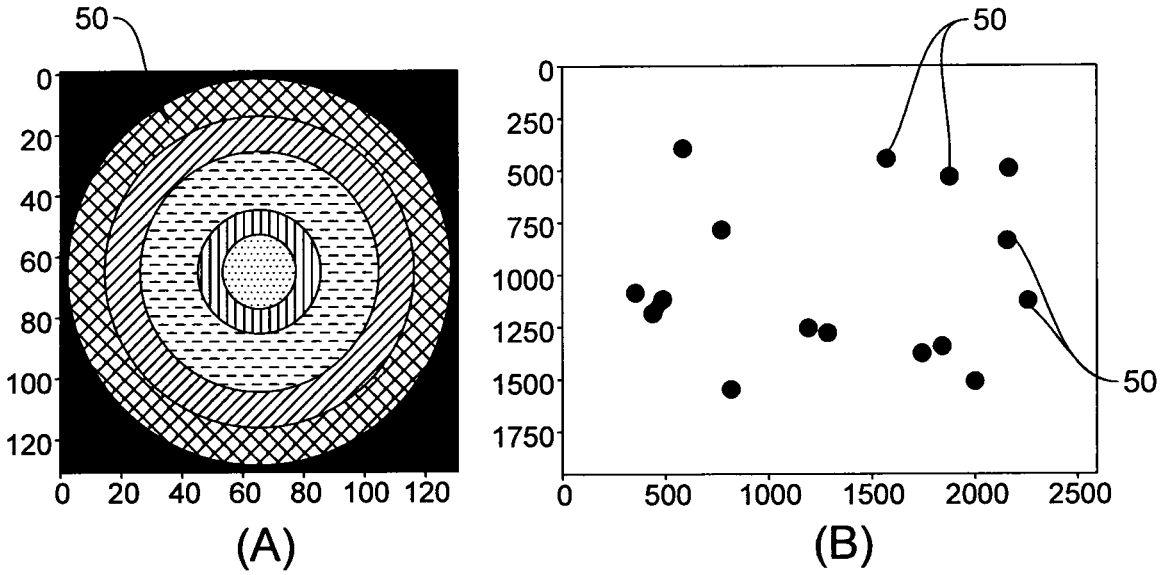
FIGS. 15(*a*) and (*b*) show the generation of a mean intensity profile of each ball to identify the centre of each balls via local maxima pixels and to separate the balls from each other as provided by the controller of the system for automatic computed monitoring and managing of a billiard game in accordance with a nonlimiting illustrative embodiment of the present disclosure.

The goal of localisation is to further separate (distinguish) the balls 50 from one another as well as to identify their position following the detection/segmentation step. In an embodiment, a multiscale correlation approach using a Laplacian-of-Gaussian (LoG) kernel is implemented to replicate the average distribution of the intensity profile (i.e. the mean intensity profile) along a longitudinal section of a ball 50 as shown in FIGS. 14 and 15(*a*). The intensity profile of each ball 50 varies in accordance with shadowing and light reflection and FIG. 14 shows how the mean intensity profile and the filtered mean intensity profile of the balls 50 is obtained. In FIG. 15(*b*) the white spots represent a high probability of the presence of balls 50. The respective centres of the balls are located at the local maxima (highest intensity) of each spot.

Figure 16:
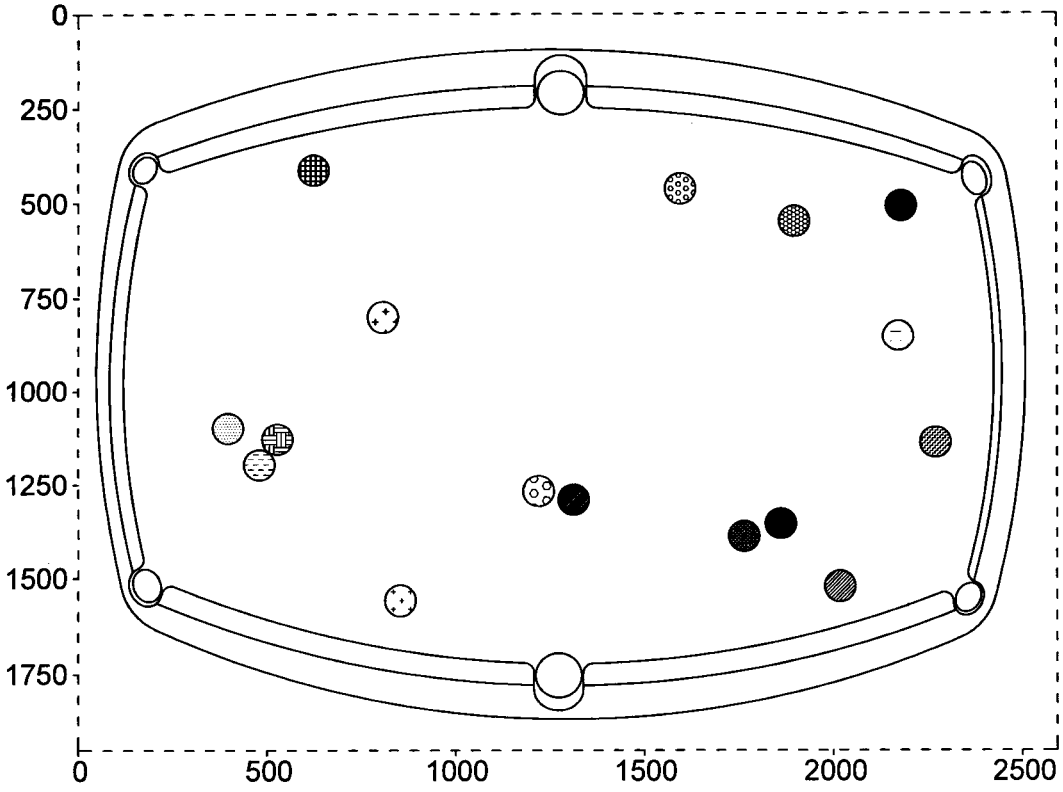
FIG. 16 shows a captured image in which the respective centre of each ball is identified by a red cross as provided by the controller of the system for automatic computed monitoring and managing of a billiard game in accordance with a non-limiting illustrative embodiment of the present disclosure.

Separating the balls 50 from each other is challenging as can be seen by FIGS. 15(*b*) and 16. In FIG. 16, the centre of each ball is marked with an X and as can be seen the exact centre is not always easy to define especially when one or more balls are grouped together. The centre of each ball is determined with a high level of precision. The contour of each ball is also determined with a high level of precision in order to only use the pixels belonging to a given ball for proper identification of that given ball. The main challenges are due to shadowing and light reflection as the balls have a very smooth and reflective surface.

iv)—Identification of the Balls Within the Image

Figure 17:
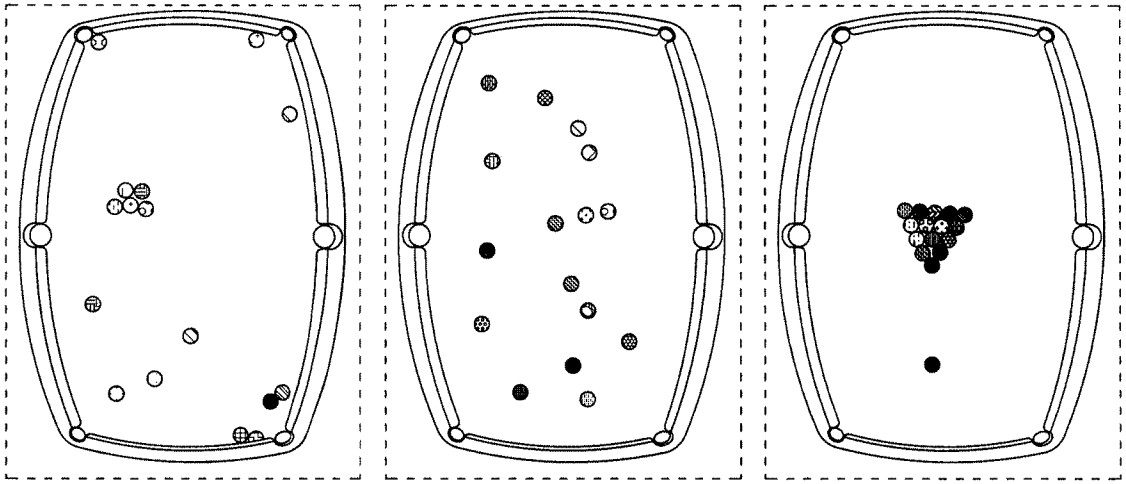
FIG. 17 shows captured images in which the balls are segmented based on machine learned colors as provided by the controller of the system for automatic computed monitoring and managing of a billiard game in accordance with a non-limiting illustrative embodiment of the present disclosure.

In accordance with an embodiment, initial machine learning of the nine principal colours of the balls (including the white cue ball and the black eight ball) is implementable by inputting the position of the balls within the image. This information is stored by the controller (e.g. C, 16) in its memory M thereby providing the controller to implement segmentation of the images based on the learned information (i.e. the nine principal colours) as shown in FIG. 17.

The identification of the balls 50 can be effectuated by comparing the proportion of the colors present in a given region of the image occupied by a given ball or balls 50.

Except for the white (cue ball) and black (eight ball) balls, all the other balls contain three colors: a) one of the primary seven colours, b) white (in the form of a circle for the ball number as well the top and bottom circles for the striped balls) and c) black for the number. In an embodiment, the black color is ignored as very few pixels in the image are dedicated to it. The balls 50 are identified by assessing the proportion of pixels of the primary color with respect to the white pixels in a given region of the image occupied by a given ball 50.

Challenges include confusion between certain colors as well the fact that the stripes in the striped balls may appear as thin lines along the circumference of the ball 50.

In an embodiment, the image capturer (e.g. E, 12, 112) provides skeletal grids in a three-dimensional virtual environment with each ball 50 having been previously uploaded and identified by the controller C (or 16). In an embodiment the cameras are 3-D cameras such as used in Kinect systems. As such, the use of such cameras provides for easily distinguishing the balls 50 from the background 28 as well as to easily segment the balls 50 when they are grouped. Accordingly, the foregoing provides for localizing balls 50 within an image based on their 3-D profile and not by their appearance. Once balls 50 are located it is then possible to simply obtain pixels belonging only to a given ball 50 thereby providing immediate identification.

In an embodiment, the cameras comprise stereo cameras, the image of each camera is used for identification which can add precision to the identification steps as the slight differences from each point of view are assessed.

Figure 18:
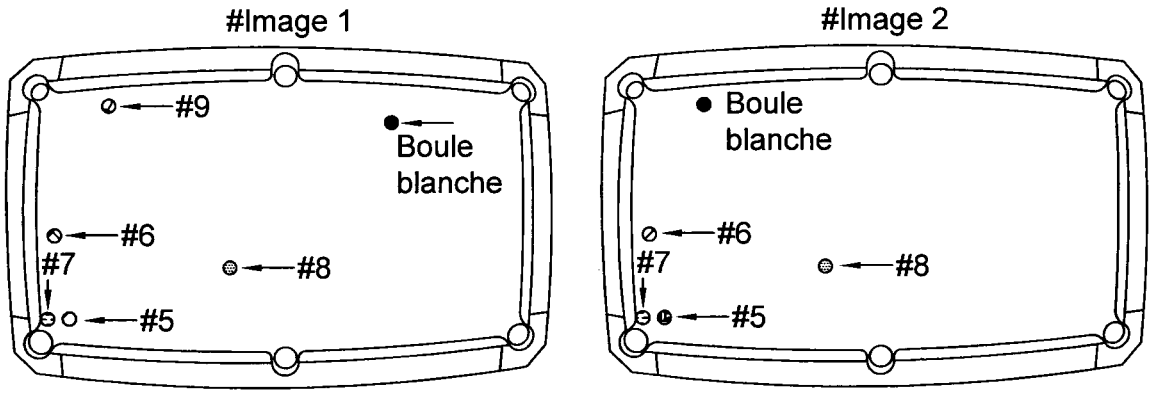
FIG. 18 shows before and after captured images for assessing movement of balls as provided by the controller of the system for automatic computed monitoring and managing of a billiard game in accordance with a non-limiting illustrative embodiment of the present disclosure.

In an embodiment and with reference to FIG. 18, the cameras take a first photo (Image #1) of the pool table 14 when no shot has been taken and the balls 50 being still and then a second photo (Image #2) is taken after a shot has been played in order to assess if there has been movement between the second image and the previous image. Video images are taken in real-time and subsequent images are compared to previous images in real time.

Figure 19:
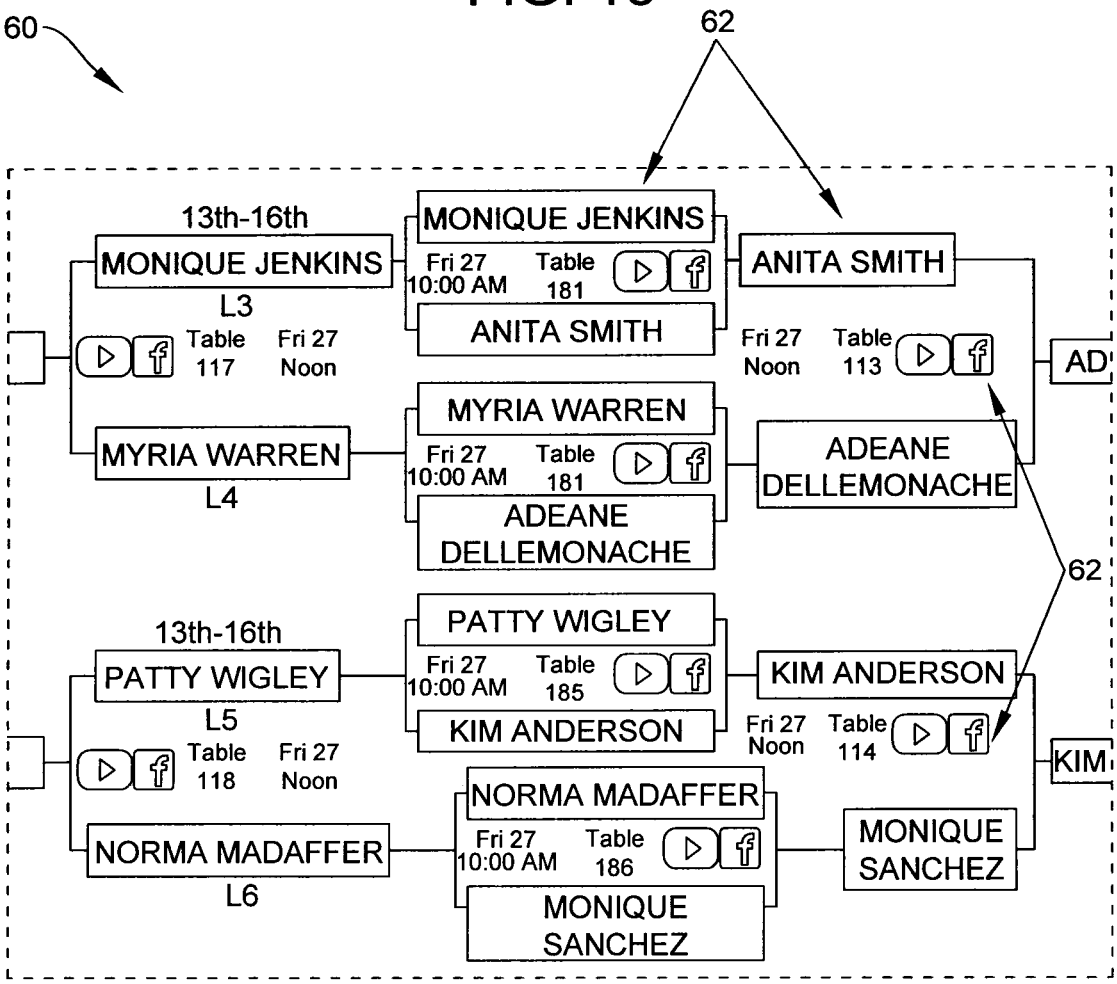
FIG. 19 is a visual platform for displaying billiard game results and captured images provided by the controller of the system for automatic computed monitoring and managing of a billiard game in accordance with a non-limiting illustrative embodiment of the present disclosure.

Turning to FIG. 19, the system provides a platform 60 for players and the public to review games via a recorded video 62 as well as to share their scores and analysis via social media 64.

The image capturer E in conjunction with the controller C, can provide for detailed analysis of a game within a virtual 3-D grid and represent game analytics to viewers via virtual reality or augmented reality displays to further explain to viewers particular details regarding angles, speed and force of cue stick strikes on cue balls, strike region on cue balls, strike regions of object balls when hit by the cue balls, types of movements of the cue balls and object balls. These precise details are amassed by the controller C in its memory in order to provide relevant game statistics as well as to provide a database/databank for research by players, enthusiasts and coaches.

In an embodiment, the image capturing system E provides for video tracking via video cameras. Video tracking provides for associating target objects in consecutive video frames. In the game of billiards the foregoing association is especially difficult because the objects (the balls) are moving fast relative to the frame rate of the video cameras. Execution of the controller (or processor) executable code in the memory M causes the controller to perform the steps of detecting the billiard balls, recognizing the billiard balls and tracking the billiard balls.

Detecting the balls: In an embodiment, the detection of balls is provided by the computer implementable step of registration algorithms between 2D images obtained from high resolution 2D color cameras and 3D depth images obtained by 3D cameras. The 3D information provided to the controller C allows the controller to determine the pixels that belong to a ball on the 2D image regardless of its contrast with respect to the mat of the billiard (i.e. playing area). It is the information of height of the pixels of the ball compared to carpet that will allows the controller to perform this segmentation. The controller also executes 2D segmentation to locate each ball and define the pixels that belong to each ball, by way of background subtraction techniques, explore binarisation methods, edge detection techniques, Blob analysis and the like.

Recognizing the balls: In an embodiment, the controller C uses different color space models (e.g. RGB, HSV, YUV, CIELAB etc.) to define the components of the color space. In one example a color space comprises 11 components RGBHSVYUCIELAB. The foregoing provides the controller to implement the step of building a histogram in the color space of all the billiard balls at different positions on the playing area of the billiard table thereby building a color space chart providing a color prediction model allowing for implementing the step of identifying which pixel belongs to which ball. In an embodiment, the controller C performs the computer implementable step of using multiple image frames received form the image capturing system for the same ball at different point of view shots in order for the controller to recognize a specific ball. it should be noted that near the end of a ball movement before the ball stops, its motion is slower which allows for more image frames where the cameras capture the ball at different points of view, angles of view and camera angles.

Tracking the balls tracking: In an embodiment, once the controller has detected a ball and recognized is (color, number, striped/solid) the controller performs the computer implementable step of tracking the identified ball. The controller performs the step of motion estimation for determining motion vectors that describe the transformation from one 2D image to another from adjacent frames in a video sequence received by the image capturing system E. In an embodiment, the controller performs the computer implementable step of finding motion vectors by executing and combining a pixel based method (featureless) and a feature based method. The controller also calculated the motion vectors of the balls via optical flow methods and combines the motion vectors with extracted features such as the blobs of the balls. In an embodiment, the controller performs the computer implementable step of image alignment and stitching for multiple high resolution images to track the balls, as multiple cameras are used the cover the filed of view of the entire pool table (inclusive of the playing area.

Figure 20A:
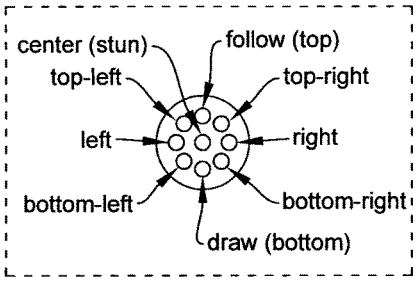
FIG. 20A is a controller generated image identifying striking spots on a cue ball in accordance with a non-limiting illustrative embodiment of the present disclosure.
Figure 20B:
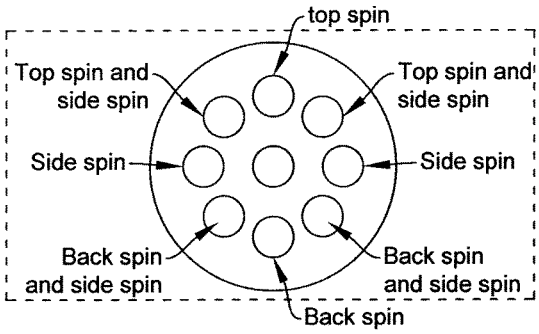
FIG. 20B is a controller generated image identifying the movement type resulting from striking a give striking spot on a cue ball in accordance with a nonlimiting illustrative embodiment of the present disclosure.
Figure 21A:
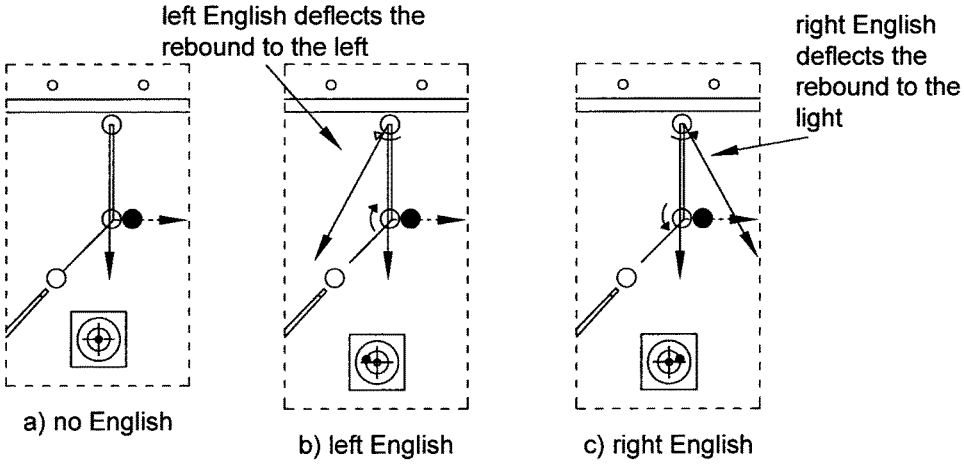
FIGS. 21A and 21B are controller generated image providing probable trajectories or resultant trajectories of balls based on strikes on given striking spots of cue balls in accordance with a non-limiting illustrative embodiment of the present disclosure.
Figure 21B:
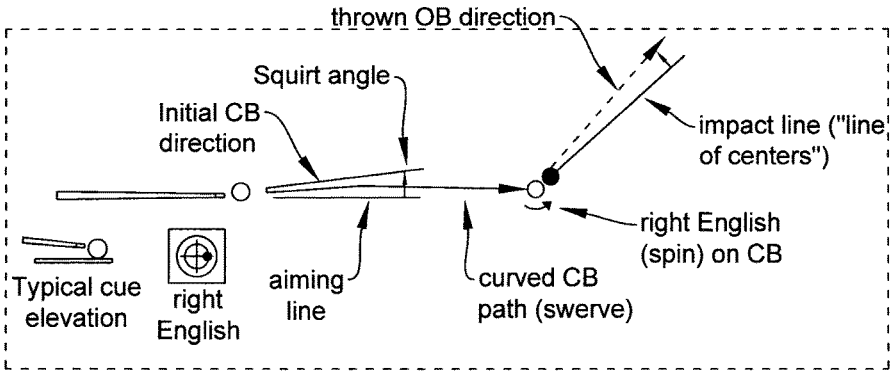

Turning to FIGS. 20A and 20B, as is known in the cue sport techniques, striking the cue ball in the different points (e.g. center, top, bottom, left, right, top-left, bottom-left, top-right, bottom-right) will result, in different respective movements (e.g. pure sliding via a center stun shot, top spin, bottom spin, side spin top and side spin, bottom and side spin). As further shown in FIGS. 21A and 21B the system can assess the based on predetermined input and machine learning the type of strike on the cue ball and the subsequent movements of the cue ball and the object ball. As such, the memory M contains a database (such as 17) of cue sport techniques including the relationship between the area on the ball (see FIG. 20A) that is struck by the cue stick and the resulting movement and ball trajectory, type of impact of the cue ball on the object ball and type of movement on the object ball and any subsequent balls. The image capturing system E provides captured detailed images including the strike area on the ball, its movement, trajectory and impact on the object ball as well as the movement and trajectory of the object ball. The controller C receives this information in real time and provides (by executing the code in the memory M) a virtual or augmented reality representation of the shot and its resulting movements and trajectories which are displayed via the display D as shown in FIGS. 20A, 20B, 21A and 21B. The memory M (or the database 19 as schematically illustrated in FIG. 1) includes predetermined techniques and shot results based on a set of probabilities as well as previous information from the subject player and other players in order to provide statistical comparative information to the viewers and the players.

Figure 22A:
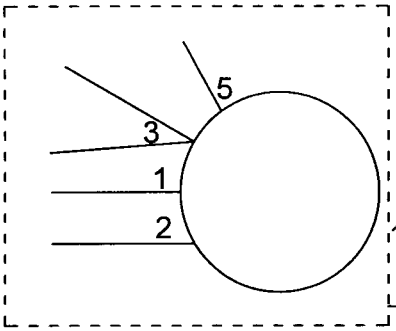
FIGS. 22A and 22B shows controller generated images providing probable or resultant trajectories of balls based on striking angles of cue sticks on cue balls in accordance with a non-limiting illustrative embodiment of the present disclosure.
Figure 22B:
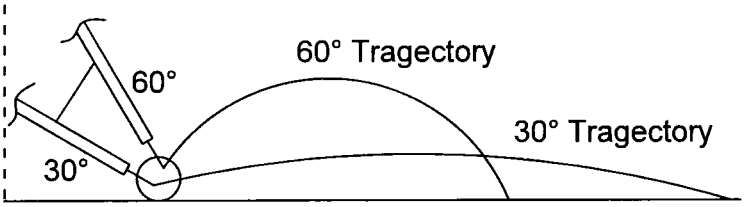

FIGS. 22A and 22B are representative images provide by the display D based on the elevation or angle of the cue stick when striking the cue ball. It is known in the art that certain cue stick angles provide certain trajectories. The memory M (or the database 19) contains this information, the controller implements a comparison between the information contained in the memory or database and the real game shot to provide comparative representation to the viewer and the players via a display and to keep track of comparative information. Once again, the image capturing system E provides the controller C with detailed images which are then analyzed within a 3-D grid to ascertain the angle of the cue stick when striking the ball as well as the point of the strike on the ball as mentioned above. The movement and trajectory of the ball and its impact on the object ball and subsequent balls is then assessed and compared to the information in the database 19 which can be contained within the memory M. In an embodiment, the controller comprises a separate memory M of controller executable code and a separate database 19. In an embodiment, the database 19 forms part of the memory M.

Figure 23:
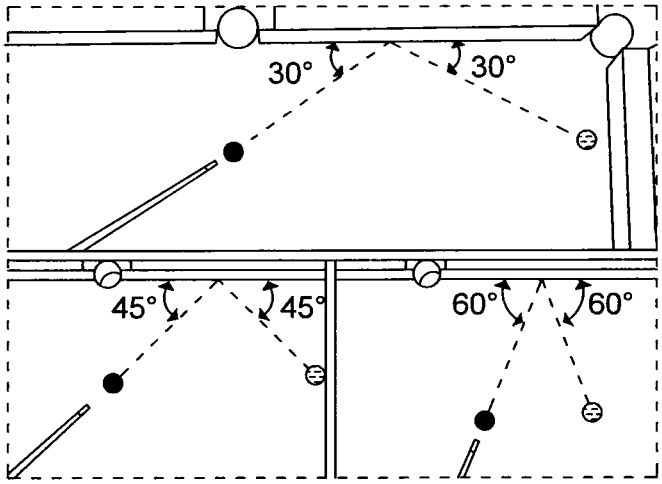
FIG. 23 shows controller generated images of cue ball angle directions on rail and resulting bounce off angle directions in accordance with a non-limiting illustrative embodiment of the present disclosure.

FIG. 23 is a representation of the reflection movement of the cue ball caroms the cushioned edge (or rail), the angle of the cue ball when it approaches the rail is equal to the angle when the ball bounces off the rail. As such, the controller C can assess this angle and provide a representation or slow-motion replay of it via the display D as well as a comparative analysis based on the information amassed in the database 19 (which can be contained within the memory M).

Figure 24:
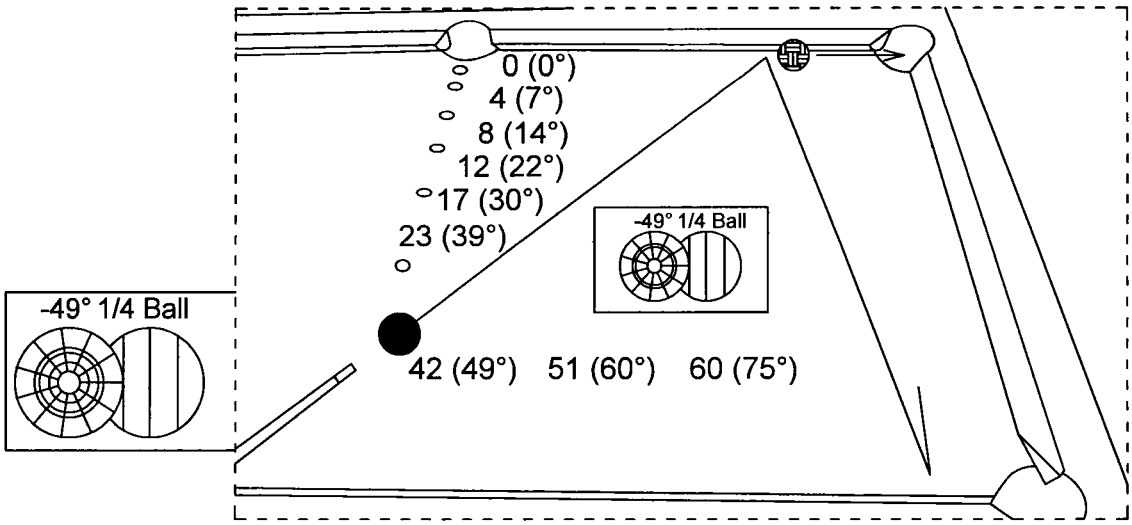
FIG. 24 shows controller generated images of types of cue ball strikes on object balls and probable or resultant trajectories of object balls in accordance with a non-limiting illustrative embodiment of the present disclosure.

Turning now to FIG. 24, it is known in the art most shots in billiards are angle shots or "cuts," meaning the cue ball does not strike the object ball dead on. The "thinner" (more glancing) the collision is, the greater the angle the object ball will travel at, relative to the trajectory of the cue ball. The image capturing system E provides the controller with detailed image information that is assessed in a 3-D grid by the controller C in order to determine what portion of the cue ball impacted what portion of the object ball and to provide the resulting trajectory thereof. This information can be provided in a virtual or augment reality representation via the display D as well as provide comparative information to the viewers and players as previously described.

The foregoing information forms part of the billiard game information along with the billiard game rules contained within a database such as database 19 which can be part of the memory M associated with the controller C or the processor (such as processor 17 schematically illustrated in FIG. 1).

Figure 25:
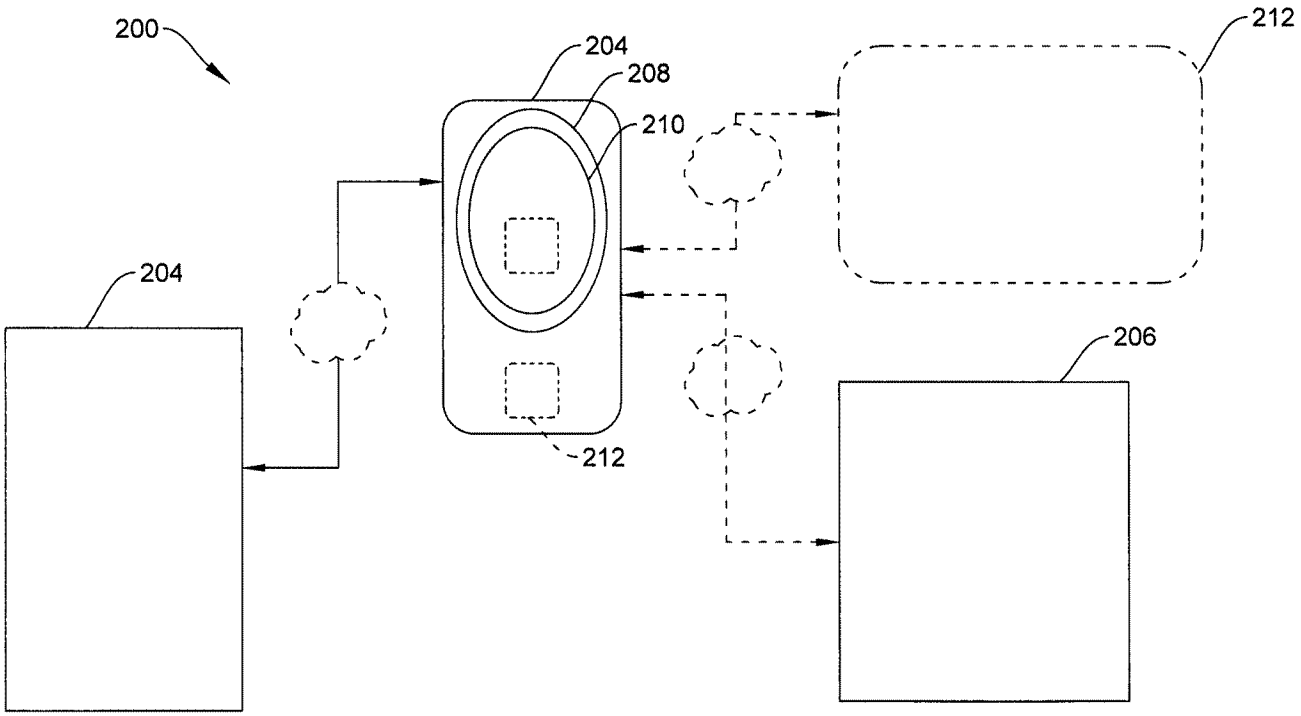
FIG. 25 is a schematic representation of a system for automatic computed monitoring and managing of a billiard game in accordance with a non-limiting illustrative embodiment of the present disclosure.
Figure 26:
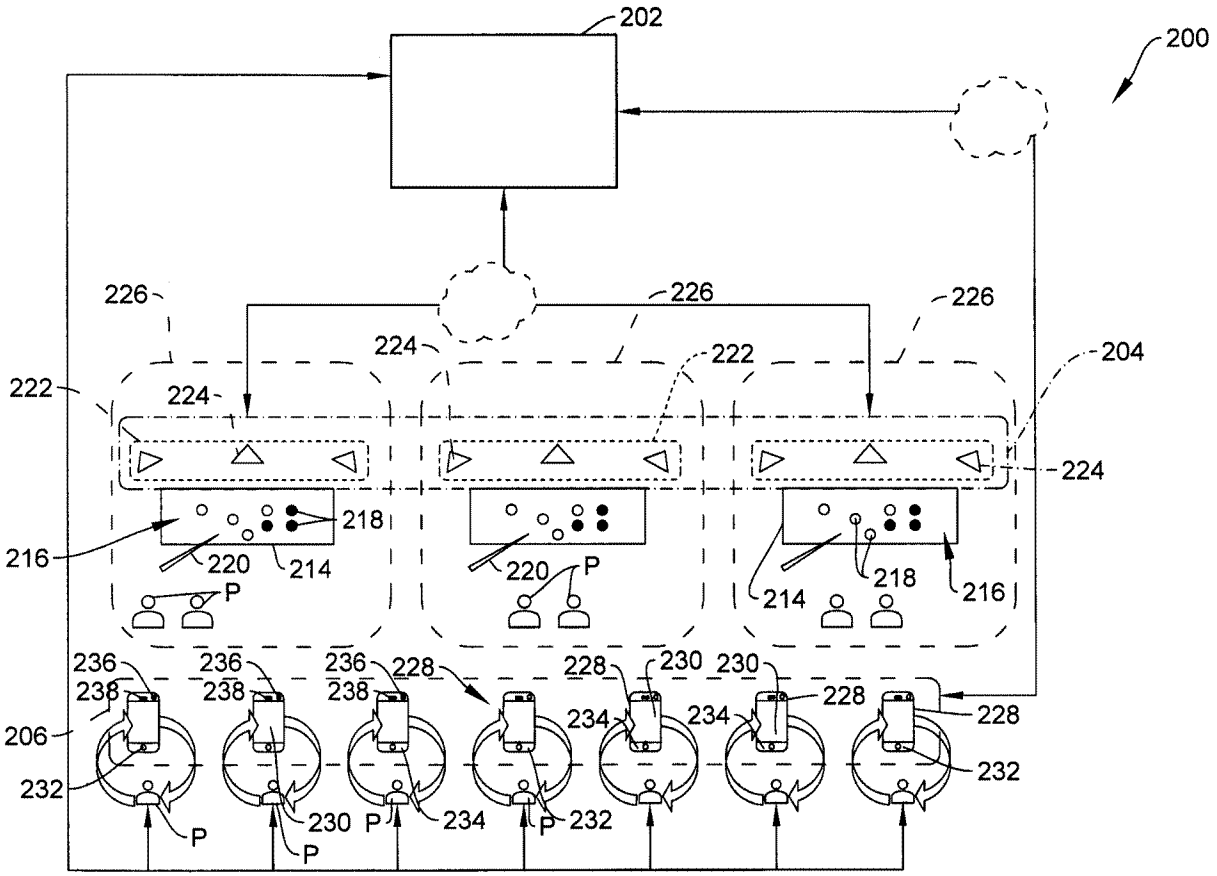
FIG. 26 is another schematic representation of the system of FIG. 25.

Turning now to FIGS. 25 and 26, there is shown a system 200 far automatic computer monitoring and management of a billiard game. The system 200 is shown comprising a controller 202, an image capturing system 204 and a user interface 206.

The controller 202 is shown comprising a processor 208 with an associated memory 210 of processor executable code and a database 212 of billiard game information. The skilled artisan will appreciate that in an embodiment, the controller is the processor and, in another embodiment, the controller comprises an integrated or associated processor unit. A variety of computer and server configurations can be contemplated by the skilled artisan within the context of the present disclosure. Similarly, the skilled artisan will appreciate that the database 212 can be provided within the memory 210 or be a separate module within the controller 202 or be a separate module separate from the controller 202, the controller 202 being in operative communication therewith via wire or wireless communication such as via network or via the cloud through the internet and the like as the skilled artisan will easily appreciate.

As shown in FIG. 26, the image capturing system 204 is configured for capturing real time images of the billiard game 226 including a billiard table 214, a playing surface area 216 of the billiard table 214, balls 218 on the playing surface area 214, cue sticks 220 engaging the balls 218 and movement type and trajectory of the balls 218 on the playing surface 214. The image capturing system 204 is configured for and is in operative communication with the controller 202 for providing the real time captured images of the billiard game 226 thereto.

The user interface 206 is configured for and is in operative communication with the controller 202. This operative communication is wireless such as via a network, remote communication, the cloud and the like otherwise this operative communication can be via wire connection.

The controller 202 is configured for and is in operative communication with the user interface 206 and the image capturing system 204. This operative communication is wireless such as via a network, remote communication, the cloud and the like otherwise this operative communication can be via wire connection.

The image capturing system 204 is shown comprising a plurality of image capturers 222. Each image capturer 222 is shown comprising an assembly of image capturing devices 224 such as cameras. In an embodiment, the image capturing system 204 comprises only one image capturer 222 for monitoring only one billiard table 214. In an embodiment and as shown in FIG. 26, the image capturing system 204 provides for real time capturing of images from a plurality of billiard tables 214, thereby allowing the system to monitor a plurality of games 226.

FIG. 26 shows the user interface 206, comprising a plurality of interface devices 228. The interface devices 228 can be common devices for a plurality of users as discussed herein or personal devices as also previously discussed. The devices 228 comprise display devices 230 such as display screens for displaying controller provided images. The device 228 also comprises an input module which includes a key touch pad 232, the screen 228, a microphone 234, a camera 236 and any combination thereof. In an embodiment, the camera 236 also forms part of the image capturing system 204. In an embodiment, the device 228 also includes a speaker 238 for communicating relevant information from the controller 202 via the screen 230 and/or the speaker 238. Of course, the skilled artisan can contemplate a variety of interface set ups, devices, structures including a combination of common screens, remote monitors and personal handheld devices thereby providing the controller 202 to selectively communicate certain information to certain users while not communicating other information to certain users (for example, information communicated to players and spectators may differ etc.).

When the processor executable code in the memory 210 is executed it causes the controller 202 to perform computer implementable steps comprising: storing player information in the database 212, identifying players P, identifying the balls 218, assessing billiard game 226 results and communicating the assessed results.

The controller 202 stores in the database 212 player information via data input. The data input can be in the form of player-identification inputs via the user interface 206. These inputs include player ID information via keypad entries, or voice inputs via the microphone 234, facial recognition camera systems recognizing the players P (these facial recognition cameras forming part of the image capturing system 204 and can be on the interface device 228). In an embodiment, the players P have ID cards and provide the foregoing input via scanning an ID card via a scanner (forming part of the user interface 206). In an embodiment, the players P have smartcards which are read by sensors in the game area. The smartcards include smart labels. In an embodiment, the users have tags which are identified by RFID devices. The foregoing identifications devices form part of the user interface 206. Various combinations of the foregoing can also be required to store the player information in the database 212. Once the player information has been stored in the database 212, the player P can be identified by the system 200 via one of previous methods and any combination thereof; the controller 202 performs the step of comparing the player identification inputs (code, ID card, facial recognition, voice activated input etc.) to the stored information in the database 212 to identify a player P by associating a player P to their stored information once a computer assessment has been made. The controller 202 monitors the player P during their various games 226 and in tournaments. Thus, the controller 202 is aware of which player P is at which billiard table 214 as well as the performance of that player P.

The controller 202 identifies the balls 218 on the playing surface area 216 of the billiard table 214 by way of data input comprising receiving the real time captured images of the balls on the playing surface 216 from the image capturing system 204 and implementing the detection, identification, recognition and tracking computer implementable steps provided herein.

The controller 202 associates a respective set of the identified balls with a respective one of the identified players P by way of data input comprising receiving the real time captured images of the billiard game 226 and comparing the real time captured images of the billiard game with the stored billiard game information thereby identifying a game relationship between a given one of the identified players and a respective one of the set of identified balls. A game relationship for example is that the solid balls are to be played by one of the players P and the striped balls by the other one of the players P. This decision is done at the break as is known in the game of billiards.

The controller 202 assesses billiard game results by monitoring the movement type and the trajectory of each of the identified balls 218 on the playing surface area by way of data input. This data input comprises receiving the real time captured images of the billiard game 226 via the image capturing system 204 and executing the ball tracking computer implementable steps herein. The controller 202 thus assess the billiard game activity, which comprises which player is striking and the results of that strike (movement type and trajectory). The assessed real time images are thus compared of the billiard game activity to the stored information in the database 212 (e.g. point rules). Since the controller 202 knows which balls 218 are associated with which players P, the controller can assess the game results based on the stored point allotment scheme and stored game rules (all of which are in the database 212). The controller 202 then implements the step of communicating the assessed billiard game results via the user interface 206 or one of the devices 228 via the screen 230 of the microphone 238 or combinations thereby to provide just two non-limiting examples.

The system 200 also provides for automatic computer monitoring and management of a billiard game tournament. Thus, as shown in FIG. 26, the image capturing system 204 is configured for capturing the real time images of a plurality of concurrent and successive ones of the billiard games 226 within a billiard tournament of a plurality of the billiard game players P. The image capturing system 204 is configured for providing the captured images of the plurality of concurrent and successive ones of the billiard games 226 within the billiard tournament to the controller 202 for performing assessing of billiard game results of each of the plurality of concurrent and successive ones of the billiard games 226. The database 212 comprises billiard tournament information which forms part of the already discussed billiard game information.

The execution of the controller executable code causes the controller 202 to perform computer implementable steps required for managing the tournament and updating the players P in relation thereto. The controller 202 thus performs the step of evaluating a game score of each of the players P based on the assessed billiard game results in each game 226 of a tournament. The controller 202 performs the step of matching selected ones of the players P (i.e. players who had a certain game result threshold and can thus advance in the tournament process of elimination). The match of selected players P are notified via a communication through the interface 204 to compete against each other in a subsequent game 226 at an assigned billiard table 214 in the billiard playing hall based on the evaluated game scores in accordance with the rules of the tournament (which the controller 202 has stored in its database 212). As such, the controller 202 provides for one ore more game matches 226 to be executed up until the tournament is completed in accordance with rules in the database 212. The controller 202, as mentioned herein, communicates the game matches 226 (including selected players P, table 214 and any additional rules) to the players and the public via the interface 206.

The controller 202 can also perform the step of ranking the players P based on the assessed game results over a predetermined period of games and/or number of games and to communicate this ranking to players P and/or spectators via the user interface 206. Thus, in a tournament, players P and spectators may have access to the ranking of all the players P in the contest for example. Furthermore, the controller 202 can also perform the computer implementable step of matching selected ones of the players P to compete against each other in a subsequent billiard game based on the ranking thereby providing one or more ranked game matches and then to communicate the one or more ranked game matches via the user interface 206.

The controller 202 performs the computer executable step of assessing player performance for a given player P. In order to accomplish this, the controller 202 monitors via the image capturing system 204 cue stick 220 strikes on the identified balls 218 and the resulting movement type and the trajectory of the identified balls on the playing surface area by way of data input comprising receiving the real time captured images of the billiard game 226. These real time images are compared to the stored billiard game information in order to assess player performance. Player performance also comprises the evaluated player caliber. The foregoing is of course communicated to the interested parties (players P and/or spectators) via the user interface 206.

In order to evaluate the caliber of a player P, the player is rated. In an embodiment, the player P may perform player rating drills such as "playing the ghost". A ghost drill consists of the player not playing against another player but basically performing alone a set of drills, "Playing the ghost" drills are useful to rate player's level of play and track improvement over time. These drills are well known in the art and therefore can be uploaded into the stored billiard information to provide a comparison system for rating the player P being automatically computer monitored. The controller 202 may thus store the various ghost drills (video, computer generated animation, still images, controller generated analysis) and provide access to them to other players P and/or spectators under a set of predetermined conditions (such as payment of a membership fee etc.).

In an embodiment, the stored billiard game information within the database 212 comprises the Billiard University (BU) rating system. The BU rating comparison chart shows how the BU rating correlates to other commonly used rating and handicapping systems. As with all rating systems and drills, results can vary with table size. In an embodiment, the stored billiard game information comprises the Table Difficulty Factor (TDF) which offers a way to compare difficulty levels of different tables to help put scores and ratings into proper perspective. Interpretations of the A-D ratings can vary in different regions and among different league/tournament systems. Thus, when constructing the database 212 the proper billiard game information is stored thereon related to the game/tournament to be monitored and managed by the system 200.

The controller performs the computer implementable steps of accumulating the assessed player performance of a plurality of players P over a plurality of the billiard games 226 and of them in the database 212 for analysis thereof to provide statistics. These statistics can be analyzed by players P, coaches, game enthusiasts, researchers, sports commentators and the like via the user interface 206 under a predetermined set of conditions. The controller 202 can thus assess game playing strategies based on the billiard game statistics or based on the billiard game statistics and the stored billiard game information. These strategies can be communicated via the interface 204 in the form of educational interactive virtual coaching sessions generated by the controller 202.

As previously mentioned, the user interface 206 relates to one or a plurality of interface devices and the execution of the controller executable code causes the controller 202 to perform the computer implementable step of selectively providing information related to billiard game activity to the one or more interface devices 238 and/or a selective subset thereof as per a predetermined set of conditions contained with the stored billiard information.

The present disclosure provides various systems 10, 100, S, 200 which comprise various apparatuses of the component parts thereof for the automatic computer monitoring and management of a billiard game.

The systems 10, 100, S, and 200 and the apparatuses thereof including the various components and configurations thereof can be combined in various ways to provide other systems and apparatuses for automatic computer monitoring of and management of a billiard game within the context of the present disclosure. The apparatuses herein can be provided in kits for assembly thereof. The systems, apparatus and kits herein comprises inherent methods for automatic computer monitoring of and management of a billiard game.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A system for automatic real time computer monitoring and management of a billiard game and a billiard tournament, the system comprising:

a controller comprising a processor with an associated memory of processor executable code and a database of stored billiard game information comprising billiard tournament information;

an image capturing system being configured for capturing real time images of the billiard game including a billiard table, a playing surface area of the billiard table, balls on the playing surface area, cue sticks engaging the balls and movement type and trajectory of the balls on the playing surface, the image capturing system being configured for and in operative communication with the controller for providing the real time captured images of the billiard game thereto, wherein the image capturing system is configured for capturing the real time images of a plurality of concurrent and successive ones of the billiard games within the billiard tournament of a plurality of the billiard game players and for providing the captured images thereof to the controller in real time for real time the assessing of billiard game results of each of the plurality of concurrent and successive ones of the billiard games;

a mobile user interface configured for and in operative communication with the controller;

wherein the controller is configured for and in operative communication with the user interface and the image capturing system;

wherein execution of the processor executable code causes the controller to perform the computer implementable steps of:

storing in the database player information via data input selected from the group consisting of user player-identification inputs via the user interface, real time player images captured by the image capturing system, and any combination thereof;

identifying players of the billiard game by assessing the stored player information to associate the players to the billiard table;

individually identifying each of the balls on the playing surface area of the billiard table by way of data input comprising receiving the real time captured images of the balls on the playing surface from the image capturing system;

associating a respective set of the identified balls with a respective one of the identified players by way of data input comprising receiving the real time captured images of the billiard game and comparing the real time captured images of the billiard game with the stored billiard game information thereby identifying a game relationship between a given one of the identified players and a respective one of the set of identified balls;

assessing billiard game results by real time monitoring the real time movement type and the real time trajectory of each of the individually identified balls on the playing surface area by way of data input comprising receiving the real time captured images of the billiard game and comparing the real time captured images of the billiard game to the stored billiard game information wherein each identified ball being monitored is associated to a given one of the identified players based on the identified game relationship;

communicating the assessed billiard game results via the mobile user interface;

evaluating a game score of each of the players in real time based on the assessed billiard game results;

matching selected ones of the players in real time to compete against each other in a subsequent billiard game based on the evaluated game scores in accordance with the tournament information thereby providing one or more game matches;

communicating the one or more game matches via the mobile user interface;

assigning a respective billiard table in real time to the one or more game matches;

communicating the billiard table assignment in real time via the mobile user interface;

ranking the players based on the assessed billiard game results and the trajectory of the ball movements; and communicating the ranking via the mobile user interface.

2. A system according to claim 1, wherein execution of the processor executable code causes the controller to perform the computer implementable steps of:

matching selected ones of the players to compete against each other in a subsequent billiard game based on the ranking thereby providing one or more ranked game matches; and communicating the one or more ranked game matches via the user interface.

3. A system according to claim 1, wherein execution of the processor executable code causes the controller to perform the computer implementable steps of:

assessing player performance for a given player by monitoring cue stick strikes on the identified balls and the resulting movement type and the trajectory of the identified balls on the playing surface area by way of data input comprising receiving the real time captured images of the billiard game and comparing the real time captured images of the billiard game to the stored billiard game information in order to assess player performance, wherein the assessed player performance comprises evaluated player caliber;

communicating the assessed player performance via the user interface.

4. A system according to claim 3, wherein execution of the processor executable code causes the controller to perform the computer implementable steps of:

accumulating the assessed player performance of a plurality of players over a plurality of the billiard games;

storing the accumulated player performance in the database;

analyzing the accumulated player performance in order to provide billiard game statistics.

5. A system according to claim 4, wherein execution of the processor executable code causes the controller to perform the computer implementable step of:

communicating the billiard game statistics via the user interface.

6. A system according to claim 5, wherein execution of the processor executable code causes the controller to perform the computer implementable step of:

assessing game playing strategies based on the billiard game statistics or based on the billiard game statistics and the billiard game information.

7. A system according to claim 1, wherein execution of the controller executable code causes the controller to perform the computer implementable step of selectively providing information related to billiard game activity to the mobile user interface.

8. A system according to claim 1, wherein the mobile user interface comprises a display for displaying controller provided images.

9. A system according to claim 8, wherein the controller provided images are selected from the group consisting of real time captured images, controller generated images and a combination thereof.

10. A system according to claim 1, wherein the mobile user interface comprises at least one input module being configured for allowing billiard players to the player-identification information to the database.

11. A system according to claim 1, wherein the image capturing system comprises an image capturer.

12. A system according to claim 11, wherein the image capturer comprises at least one camera.

13. A system according to claim 12, wherein the at least one camera comprises an RGB camera.

* * * * *